US008820895B2

(12) United States Patent
Bibl et al.

(10) Patent No.: US 8,820,895 B2
(45) Date of Patent: Sep. 2, 2014

(54) MEMS JETTING STRUCTURE FOR DENSE PACKING

(75) Inventors: Andreas Bibl, Los Altos, CA (US); Kevin Von Essen, San Jose, CA (US); Paul A. Hoisington, Hanover, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 753 days.

(21) Appl. No.: 12/833,828

(22) Filed: Jul. 9, 2010

(65) Prior Publication Data

US 2011/0007117 A1 Jan. 13, 2011

Related U.S. Application Data

(60) Provisional application No. 61/224,847, filed on Jul. 10, 2009.

(51) Int. Cl.
*B41J 2/045* (2006.01)
*B41J 2/14* (2006.01)

(52) U.S. Cl.
CPC ..... *B41J 2/14233* (2013.01); *B41J 2/14056* (2013.01); *B41J 2002/14241* (2013.01); *B41J 2/1404* (2013.01); *B41J 2202/12* (2013.01); *B41J 2002/14491* (2013.01)
USPC ..... 347/70; 347/68; 347/71; 347/72; 347/50

(58) Field of Classification Search
CPC ..... B41J 2002/14491; B41J 2202/20; B41J 2/14233; B41J 2/1404; B41J 2/14056
USPC ..... 347/70–72, 68, 40, 48, 50
See application file for complete search history.

(56) References Cited

U.S. PATENT DOCUMENTS

| | | | |
|---|---|---|---|
| 5,453,770 | A | 9/1995 | Katakura et al. |
| 5,889,539 | A | 3/1999 | Kamoi et al. |
| 6,019,457 | A | 2/2000 | Silverbrook |
| 6,071,750 | A | 6/2000 | Silverbrook |
| 6,142,614 | A | 11/2000 | Hashizume et al. |
| 6,213,558 | B1 | 4/2001 | Axelson et al. |
| 6,234,611 | B1 | 5/2001 | Silverbrook |
| 6,241,904 | B1 | 6/2001 | Silverbrook |
| 6,247,793 | B1 | 6/2001 | Silverbrook |

(Continued)

FOREIGN PATENT DOCUMENTS

| | | |
|---|---|---|
| CN | 1375879 | 10/2002 |
| CN | 1172800 | 10/2004 |

(Continued)

OTHER PUBLICATIONS

Authorized Officer Kyeong Sook Yeo, International Search Report and the Written Opinion for Application No. PCT/US2010/040938, mailed Feb. 1, 2011, 18 pages.

(Continued)

*Primary Examiner* — Henok Legesse
(74) *Attorney, Agent, or Firm* — Fish & Richardson P.C.

(57) ABSTRACT

A fluid ejector includes a fluid ejection module having a substrate and a layer separate from the substrate. The substrate includes a plurality of fluid ejection elements arranged in a matrix, each fluid ejection element configured to cause a fluid to be ejected from a nozzle. The layer separate from the substrate includes a plurality of electrical connections, each electrical connection adjacent to a corresponding fluid ejection element.

18 Claims, 22 Drawing Sheets

(56) References Cited

U.S. PATENT DOCUMENTS

| | | | | |
|---|---|---|---|---|
| 6,497,477 | B1 * | 12/2002 | Nakamura et al. | 347/70 |
| 6,820,969 | B2 | 11/2004 | Miyata | |
| 7,128,404 | B2 | 10/2006 | Kodama | |
| 7,252,366 | B2 | 8/2007 | Silverbrook | |
| 7,314,270 | B2 | 1/2008 | Enomoto et al. | |
| 2003/0025767 | A1 | 2/2003 | Sakamoto et al. | |
| 2006/0203042 | A1 * | 9/2006 | Murata et al. | 347/70 |
| 2007/0146440 | A1 | 6/2007 | Kojima et al. | |
| 2007/0211108 | A1 | 9/2007 | Enomoto et al. | |
| 2007/0296753 | A1 * | 12/2007 | Ito | 347/19 |
| 2011/0018938 | A1 * | 1/2011 | Rivas et al. | 347/45 |

FOREIGN PATENT DOCUMENTS

| | | |
|---|---|---|
| JP | 05-124198 | 5/1993 |
| JP | 09-066602 | 3/1997 |
| JP | 2002-254635 | 9/2002 |
| JP | 2005-035291 | 2/2005 |
| JP | 2006-082480 | 3/2006 |
| JP | 2006-281777 | 10/2006 |
| JP | 2008-230139 | 10/2008 |
| KR | 10-0481996 | 4/2005 |
| KR | 10-2007-0069024 | 7/2007 |

OTHER PUBLICATIONS

Chinese Office Action, with English translation, CN application No. 201080039945.4, Dec. 23, 2013, 37 pages.

Japanese Office Action, with English Translation, JP Application No. 2012-519625, issued Feb. 18, 2014, 9 pages.

* cited by examiner

MEMS JETTING STRUCTURE FOR DENSE PACKING

CROSS-REFERENCE TO RELATED APPLICATIONS

This application claims the benefit of priority to U.S. Provisional Application Ser. No. 61/224,847, filed on Jul. 10, 2009, which is incorporated by reference.

TECHNICAL FIELD

The present disclosure relates generally to fluid ejection.

BACKGROUND

Microelectromechanical systems, or MEMS-based devices, can be used in a variety of applications, such as accelerometers, gyroscopes, pressure sensors or transducers, displays, optical switches, and fluid ejectors. Typically, one or more individual devices are formed on a single die, such as a die formed of an insulating material, a semiconducting material or a combination of materials. The die can be processed using semiconducting processing techniques, such as photolithography, deposition, and etching.

A fluid ejection device can have multiple MEMS devices that are each capable of ejecting fluid droplets from a nozzle onto a medium. In some devices that use a mechanically based actuator to eject the fluid droplets, the nozzles are each fluidically connected to a fluid path that includes a fluid pumping chamber. The fluid pumping chamber is actuated by the actuator, which temporarily modifies the volume of the pumping chamber and causes ejection of a fluid droplet. The medium can be moved relative to the die. The ejection of a fluid droplet from a particular nozzle is timed with the movement of the medium to place a fluid droplet at a desired location on the medium.

The density of nozzles in the fluid ejection module has increased as fabrication methods improve. For example, MEMS-based devices fabricated on silicon wafers are formed in dies with a smaller footprint and with a nozzle density higher than in previous dies. One obstacle in constructing smaller dies is that the smaller footprint of such devices can reduce the area available for electrical contacts on the die.

SUMMARY

In general, in one aspect, a fluid ejection system includes a printhead module comprising a plurality of individually controllable fluid ejection elements and a plurality of nozzles for ejecting fluid when the plurality of fluid ejection elements are actuated, wherein the plurality of fluid ejection elements and the plurality of nozzles are arranged in a matrix having rows and columns, there are at least 550 nozzles in an area that is less than one square inch, and the nozzles are uniformly spaced in each row.

This and other embodiments can optionally include one or more of the following features. There can be between 550 and 60,000 nozzles in an area that is less than one square inch. There can be approximately 1200 nozzles in an area that is less than one square inch. The matrix can include 80 columns and 18 rows. The matrix can be such that droplets of fluid can be dispensed from the nozzles onto a media in a single pass to form a line of pixels on the media with a density greater than 600 dpi. The density can be approximately 1200 dpi. The columns can be arranged along a width of the printhead module, the width being less than 10 mm, and the rows can be arranged along a length of the printhead module, the length being between 30 mm and 40 mm. The width can be approximately 5 mm. The plurality of nozzles can be configured to eject fluid having a droplet size of between 0.1 pL and 100 pL. The printhead module can include silicon. The fluid ejection element can include a piezoelectric portion. A surface of the printhead including the plurality of nozzles can be shaped as a parallelogram. The nozzles can be greater than 15 μm in width. An angle between a column and a row can be less than 90°.

In general, in one aspect, a fluid ejection module includes a first layer having a plurality of nozzles formed therein, a second layer having a plurality of pumping chambers, each pumping chamber fluidically connected to a corresponding nozzle, and a plurality of fluid ejection elements, each fluid ejection element configured to cause a fluid to be ejected from a pumping chamber through an associated nozzle, wherein at least one of the first or second layers comprises a photodefinable film.

This and other embodiments can optionally include one or more of the following features. The plurality of nozzles can include between 550 and 60,000 nozzles in an area that is less than 1 square inch. The fluid ejection element can include a piezoelectric portion. The fluid ejection module can further include a layer separate from the substrate comprising a plurality of electrical connections, the electrical connections configured to apply a bias across the piezoelectric portion. The fluid ejection module can further include a plurality of fluid paths, each fluid path fluidically connected to a pumping chamber. The fluid ejection module can further include a plurality of pumping chamber inlets and a plurality of pumping chamber outlets, each pumping chamber inlet and each pumping chamber outlet fluidically connected to a fluid path of the plurality of fluid paths. The pumping chambers can be arranged in a matrix having rows and columns. An angle between the columns and rows can be less than 90%. Each pumping chamber can be approximately circular. Each pumping chamber can have a plurality of straight walls. The photodefinable film can include a photopolymer, a dry film photoresist, or a photodefinable polyimide. Each nozzle can be greater than 15 μm in width. The first layer can be less than 50 μm thick. The second layer can be less than 30 μm thick.

In general, in one aspect, a fluid ejector includes a substrate and a layer supported by the substrate. The substrate includes a plurality of pumping chambers, a plurality of pumping chamber inlets and pumping chamber outlets, each pumping chamber inlet and pumping chamber outlet fluidically connected to a pumping chamber of the plurality of pumping chambers, and a plurality of nozzles, wherein the plurality of pumping chambers, plurality of pumping chamber inlets, and plurality of pumping chamber outlets are located along a plane, and wherein each pumping chamber is positioned over and fluidically connected with a nozzle. The layer supported by the substrate includes a plurality of fluid paths therethrough, each fluid path extending from a pumping chamber inlet or pumping chamber outlet of the plurality of pumping chamber inlets and pumping chamber outlets, wherein each fluid path extends along an axis, the axis perpendicular to the plane, and a plurality of fluid ejection elements, each fluid ejection element positioned over a corresponding pumping chamber and configured to cause fluid to be ejected from the corresponding pumping chamber through a nozzle.

This and other embodiments can optionally include one or more of the following features. The substrate can include silicon. The fluid ejection element can include a piezoelectric portion. The fluid ejector can further include a layer separate from the substrate comprising a plurality of electrical connections, the electrical connections configured to apply a bias across the piezoelectric portion. A width of each of the pumping chamber inlets or pumping chamber outlets can be less than 10% of a width of each of the pumping chambers. The pumping chamber inlet and the pumping chamber outlet can extend along a same axis. A width of each of the pumping chamber inlets or pumping chamber outlets can be less than a width of each of the fluid paths. The pumping chambers can be arranged in a matrix having rows and columns. An angle between the columns and rows can be less than 90%. Each pumping chamber can be approximately circular. Each pumping chamber can have a plurality of straight walls.

In general, in one aspect, a fluid ejector includes a substrate and a layer. The substrate includes a plurality of pumping chambers and a plurality of nozzles, each pumping chamber positioned over and fluidically connected with a nozzle. The layer is on an opposite side of the substrate from the nozzles and includes a plurality of fluid ejection elements, each fluid ejection element adjacent a corresponding pumping chamber and configured to cause fluid to be ejected from the corresponding pumping chamber through a corresponding nozzle, wherein a distance from the fluid ejection element to the nozzle is less than 30 μm.

This and other embodiments can optionally include one or more of the following features. The distance can be approximately 25 μm. The substrate can include silicon. The fluid ejection element can include a piezoelectric portion. The fluid ejector can further include a layer separate from the substrate including a plurality of electrical connections, the electrical connections configured to apply a bias across the piezoelectric portion. Each of the pumping chambers can extend through a thickness that is at least 80% of a distance from the corresponding fluid ejection element to the corresponding nozzle. A height of each of the pumping chambers can be less than 50% of a shortest width of the pumping chambers. The pumping chambers can be arranged in a matrix having rows and columns. An angle between the columns and rows can be less than 90%. Each pumping chamber can be approximately circular. Each pumping chamber can have a plurality of straight walls.

In general, in one aspect, a fluid ejector includes a substrate including a plurality of pumping chambers and a plurality of nozzles, each pumping chamber positioned over and fluidically connected with a nozzle, wherein the pumping chambers are approximately 250 μm in width, and wherein there are more than 1,000 pumping chambers per square inch of the substrate.

This and other embodiments can optionally include one or more of the following features. The substrate can include silicon. The fluid ejection element can include a piezoelectric portion. The fluid ejector can further include a layer separate from the substrate including a plurality of electrical connections, the electrical connections configured to apply a bias across the piezoelectric portion. The pumping chambers can be arranged in a matrix having rows and columns. An angle between the columns and rows can be less than 90%. Each pumping chamber can be approximately circular. Each pumping chamber can have a plurality of straight walls.

In general, in one aspect, a fluid ejector includes a fluid ejection module including a substrate and a layer separate from the substrate. The substrate includes a plurality of fluid ejection elements arranged in a matrix, each fluid ejection element configured to cause a fluid to be ejected from a nozzle. The layer separate from the substrate includes a plurality of electrical connections, each electrical connection adjacent to a corresponding fluid ejection element.

This and other embodiments can optionally include one or more of the following features. The layer can further include a plurality of fluid paths therethrough. The plurality of fluid paths can be coated with a barrier material. The barrier material can include titanium, tantalum, silicon oxide, aluminum oxide, or silicon oxide. The fluid ejector can further include a barrier layer between the layer and the fluid ejection module. The barrier layer can include SU8. The layer can include a plurality of integrated switching elements. The layer can further include logic configured to control the plurality of integrated switching elements. Each fluid ejection element can be positioned adjacent to at least one switching element. There can be two switching elements for every fluid ejection element. The fluid ejector can further include a plurality of gold bumps, each gold bump configured to contact an electrode of a fluid ejection element. The electrode can be a ring electrode.

In general, in one aspect, a fluid ejector includes a fluid ejection module and an integrated circuit interposer. The fluid ejection module includes a substrate having a first plurality of fluid paths and a plurality of fluid ejection elements, each fluid ejection element configured to cause a fluid to be ejected from a nozzle of an associated fluid path. The integrated circuit interposer is mounted on the fluid ejection module and includes a second plurality of fluid paths in fluid connection with the first plurality of fluid paths, wherein the integrated circuit interposer is electrically connected with the fluid ejection module such that an electrical connection of the fluid ejection module enables a signal sent to the fluid ejection module to be transmitted to the integrated circuit interposer, processed on the integrated circuit interposer, and output to the fluid ejection module to drive at least one of the plurality of fluid ejection elements.

This and other embodiments can optionally include one or more of the following features. The second plurality of fluid paths can be coated with a barrier material. The barrier material can include titanium, tantalum, silicon oxide, aluminum oxide, or silicon oxide. The fluid ejector can further include a barrier layer between the integrated circuit interposer and the fluid ejection module. The barrier layer can include SU8. The integrated circuit interposer can include a plurality of integrated switching elements. The integrated circuit interposer can further logic configured to control the plurality of integrated switching elements. Each fluid ejection element can be positioned adjacent to at least one switching element. There can be two switching elements for every fluid ejection element. The fluid ejector can further include a plurality of gold bumps, each gold bump configured to contact an electrode of a fluid ejection element. The electrode can be a ring electrode.

In general, in one aspect, a fluid ejector includes a fluid ejection module and an integrated circuit interposer. The fluid ejection module includes a substrate having a plurality of fluid paths, each fluid path including a pumping chamber in fluid connection with a nozzle, and a plurality of fluid ejection elements, each fluid ejection element configured to cause a fluid to be ejected from a nozzle of an associated fluid path, wherein an axis extends through the pumping chamber and the nozzle in a first direction. The integrated circuit interposer includes a plurality of integrated switching elements, the integrated circuit interposer mounted on the fluid ejection module such that each of the plurality of integrated switching elements is aligned with a pumping chamber of the plurality of pumping chambers along the first direction, the integrated switching elements electrically connected with the fluid ejection module such that an electrical connection of the fluid ejection module enables a signal sent to the fluid ejection module to be transmitted to the integrated circuit interposer, processed on the integrated circuit interposer, and output to the fluid ejection module to drive at least one of the plurality of fluid ejection elements.

This and other embodiments can optionally include one or more of the following features. The integrated circuit interposer can further include a plurality of fluid paths therethrough. Each pumping chamber can be fluidically connected with at least one fluid path, the at least one fluid path extending in a first direction along a second axis, the second axis being different from the axis extending through the pumping chamber. Each pumping chamber can be fluidically connected with two fluid paths. The plurality of fluid paths can be coated with a barrier material. The barrier material can include titanium, tantalum, silicon oxide, aluminum oxide, or silicon oxide. The fluid ejector can further include a barrier layer between the integrated circuit interposer and the fluid ejection module. The barrier layer can include SU8. The integrated circuit interposer can further include logic configured to control the plurality of integrated switching elements. There can be two switching elements for every fluid ejection element. The fluid ejector can further include a plurality of gold bumps, each gold bump configured to contact an electrode of a fluid ejection element. The electrode can be a ring electrode.

In general, in one aspect, a fluid ejector includes a fluid ejection module, an integrated circuit interposer mounted on and electrically connected with the fluid ejection module, and a flexible element. The fluid ejection module includes a substrate having a plurality of fluid paths, each fluid path including a pumping chamber in fluid connection with a nozzle, and a plurality of fluid ejection elements, each fluid ejection element configured to cause a fluid to be ejected from a nozzle of an associated fluid path. The integrated circuit interposer has a width that is smaller than a width of the fluid ejection module such that the fluid ejection module comprises a ledge. The flexible element has a first edge, the first edge less than 30 μm wide, the first edge attached to the ledge of the fluid ejection module. The flexible element is in electrical connection with the fluid ejection module such that an electrical connection of the fluid ejection module enables a signal from the flexible element to the fluid ejection module to be transmitted to the integrated circuit interposer, processed on the integrated circuit interposer, and output to the fluid ejection module to drive at least one of the plurality of fluid ejection elements.

This and other embodiments can optionally include one or more of the following features. The flexible element can be attached to a surface of the fluid ejection module, the surface adjacent to the integrated circuit interposer. The flexible element can be formed on a plastic substrate. The flexible element can be a flexible circuit. The fluid ejector can further include a conductive material adjacent to and in electrical conductive communication with conductive elements on the flexible element and adjacent to and in electrical conductive communication with conductive elements on the fluid ejection module. The substrate can include silicon.

In general, in one aspect, a fluid ejector includes a fluid ejection module, an integrated circuit interposer mounted on and electrically connected with the fluid ejection module, and a flexible element attached to the fluid ejection module. The fluid ejection module includes a substrate having a plurality of fluid paths, each fluid path including a pumping chamber in fluid connection with a nozzle, and a plurality of fluid ejection elements, each fluid ejection element configured to cause a fluid to be ejected from a nozzle of an associated fluid path. The integrated circuit interposer has a width that is greater than a width of the fluid ejection module such that the integrated circuit interposer has a ledge. The flexible element is bent around the ledge of the integrated circuit interposer and adjacent to the fluid ejection module, wherein the flexible element is in electrical connection with the fluid ejection module such that an electrical connection of the fluid ejection module enables a signal from the flexible element to the fluid ejection module to be transmitted to the integrated circuit interposer, processed on the integrated circuit interposer, and output to the fluid ejection module to drive at least one of the plurality of fluid ejection elements.

This and other embodiments can optionally include one or more of the following features. The flexible element can be adjacent to a first surface of the fluid ejection module, the first surface perpendicular to a second surface of the fluid ejection module, the second surface adjacent to the integrated circuit interposer. The flexible element can be formed on a plastic substrate. The flexible element can be a flexible circuit. The fluid ejector can further include a conductive material adjacent to and in electrical conductive communication with conductive elements on the flexible element and adjacent to and in electrical conductive communication with conductive elements on the fluid ejection module. The substrate can include silicon.

In general, in one aspect, a fluid ejector includes a fluid supply and a fluid return, a fluid ejection assembly, and a housing component. The fluid ejection assembly includes a plurality of first fluid paths extending in a first direction, a plurality of second fluid paths extending in the first direction, and a plurality of pumping chambers, each pumping chamber being fluidly connected to a single first fluid path and a single second fluid path. The housing component includes a plurality of fluid inlet passages and a plurality of fluid outlet passages, each of the fluid inlet passages extending in a second direction and connecting the supply with one or more of first fluid paths, and each of the plurality of fluid outlet passages extending in the second direction and connecting the return with one or more of the second fluid paths, wherein the first direction is perpendicular to the second direction.

This and other embodiments can optionally include one or more of the following features. The fluid ejection assembly can include a silicon substrate. The first fluid paths can have a same shape as the second fluid paths. The fluid inlet passages can have a same shape as the fluid outlet passages. Each of the fluid inlet passages and fluid outlet passages can extend at least 80% of a width of the housing component.

In general, in one aspect, a method of making a fluid ejector includes patterning a wafer to form a plurality of pumping chambers, wherein the pumping chambers are approximately 250 μm in width, and wherein there are more than 1,000 pumping chambers per square inch of the wafer, and cutting the wafer into a plurality of dies such that more than three dies are formed per square inch of wafer.

This and other embodiments can optionally include one or more of the following features. The wafer can be a circle having a six-inch diameter, and at least 40 dies each having at least 300 pumping chambers can be formed on the wafer. The wafer can be a circle having a six-inch diameter, and 88 dies can be formed from the wafer. Each of the dies can be in the shape of a quadrilateral. Each of the dies can be in the shape of a parallelogram. At least one corner of the parallelogram can form an angle of less than 90°. A piezoelectric actuator can be associated with each pumping chamber.

Certain implementations may have one or more of the following advantages. Coatings can reduce or prevent fluid leakage between fluid passages and electronics. Reduced leakage can lead to longer useful lifetime of a device, more robust printing devices, and less downtime of the printer for repairs. By having a pumping chamber layer that is less than 30 μm thick, e.g., 25 μm think, the fluid can travel through the layer quickly, providing a fluid ejection device having a high natural frequency, such as between about 180 kHz and 390 kHz or greater. Thus, the fluid ejection device can be operated at high frequencies, for example, near or greater than the natural frequency of the device and with low drive voltage, for example, less than 20V (e.g. 17V). Higher frequencies allow for the same drop volume to be ejected with a larger nozzle width. Larger nozzle widths are easier to keep free from blockage and easier to make with higher reproducibility. Lower drive voltage allows for a device that is safer to operate and requires less energy use. Further, a thinner pumping chamber layer reduces the material required for forming the pumping chamber layer. Using less material, particularly of moderately valuable materials such as silicon, results in less waste and a lower cost device. Moving the electrical connections and traces into a layer separate from the die allows the pumping chamber and nozzle density to be higher. As a result, images with a resolution of 600 dpi or greater, such as 1200 dpi for single pass mode or greater than 1200 dpi for scanning mode, such as 4800 dpi or 9600 dpi, can be formed on a print media, and more substrates can be formed per wafer. The device can be free of a descender between the pumping chamber and the nozzle. The lack of a descender can speed up frequency response and improve control of the jets and the fluid meniscus. By decreasing the distance that a fluid has to travel before being ejected, the amount of fluid ejected can be controlled more easily. For example, by not having a descender between a pumping chamber and nozzle, there is less fluid in the flow path so that a smaller volume of fluid can be ejected, even with a larger nozzle. Certain layers of the device can be formed of a compliant material, which can absorb some energy from pressure waves. The absorbed energy can reduce cross-talk. Fluid inlet and outlet passages in the housing, rather than the substrate, can reduce cross-talk between fluid passages. Because densely packed nozzles and fluid passages can be more susceptible to cross-talk, moving the inlet and outlet passages to the housing can allow for more densely packed devices in a die. Less cross-talk results in less unintended ejection of droplets. More devices in a die enable a greater number of dots per inch or greater printing resolution. Bonding a flex circuit on its thinnest edge allows a smaller die to be used and allows for easier encapsulation to protect the electrical connections from fluid traveling through the fluid ejector. Moreover, bonding a flex circuit directly to the die rather than along the outside allows neighboring modules to be closer together. Further, bending a flex directly on its thinnest edge rather than bending the flex reduces stress in the flex.

The details of one or more embodiments are set forth in the accompanying drawings and the description below. Other features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

During fluid droplet ejection, such as digital ink jet printing, it is desirable to print at high speeds and at low cost while avoiding inaccuracies or defects in the printed image. For example, by decreasing a distance that a fluid volume must travel from the pumping chamber to the nozzle, by having a layer separate from the die including electrical connections to control ejection of the fluid from actuators in the die, each electrical connection adjacent to a corresponding fluid ejection element, and by including fluid inlet and outlet passages in the housing rather than the die, a low cost fluid ejector can create high quality images at high speeds.

Figure 1:
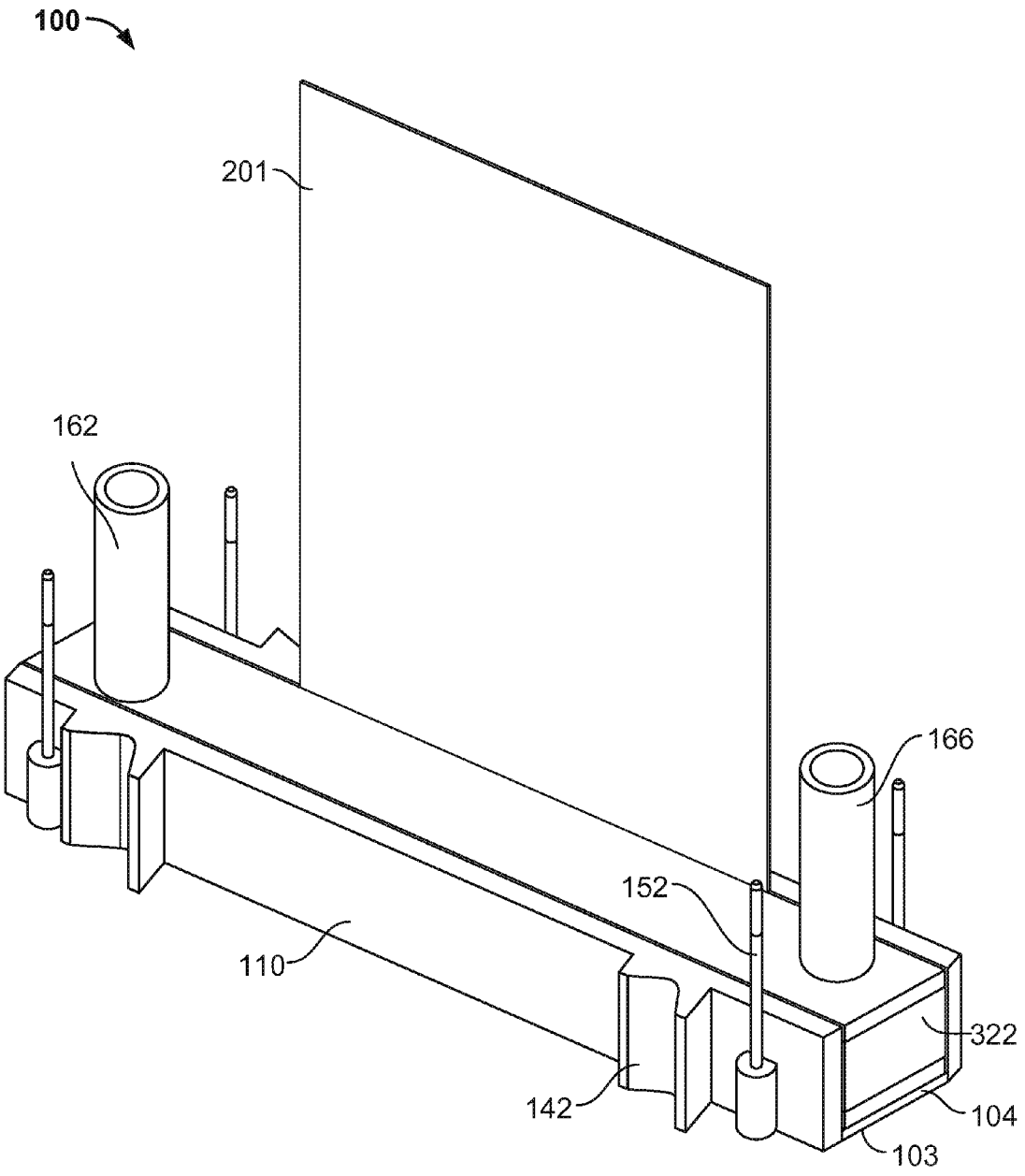
FIG. 1 is a perspective view of an exemplary fluid ejector.
Figure 2:
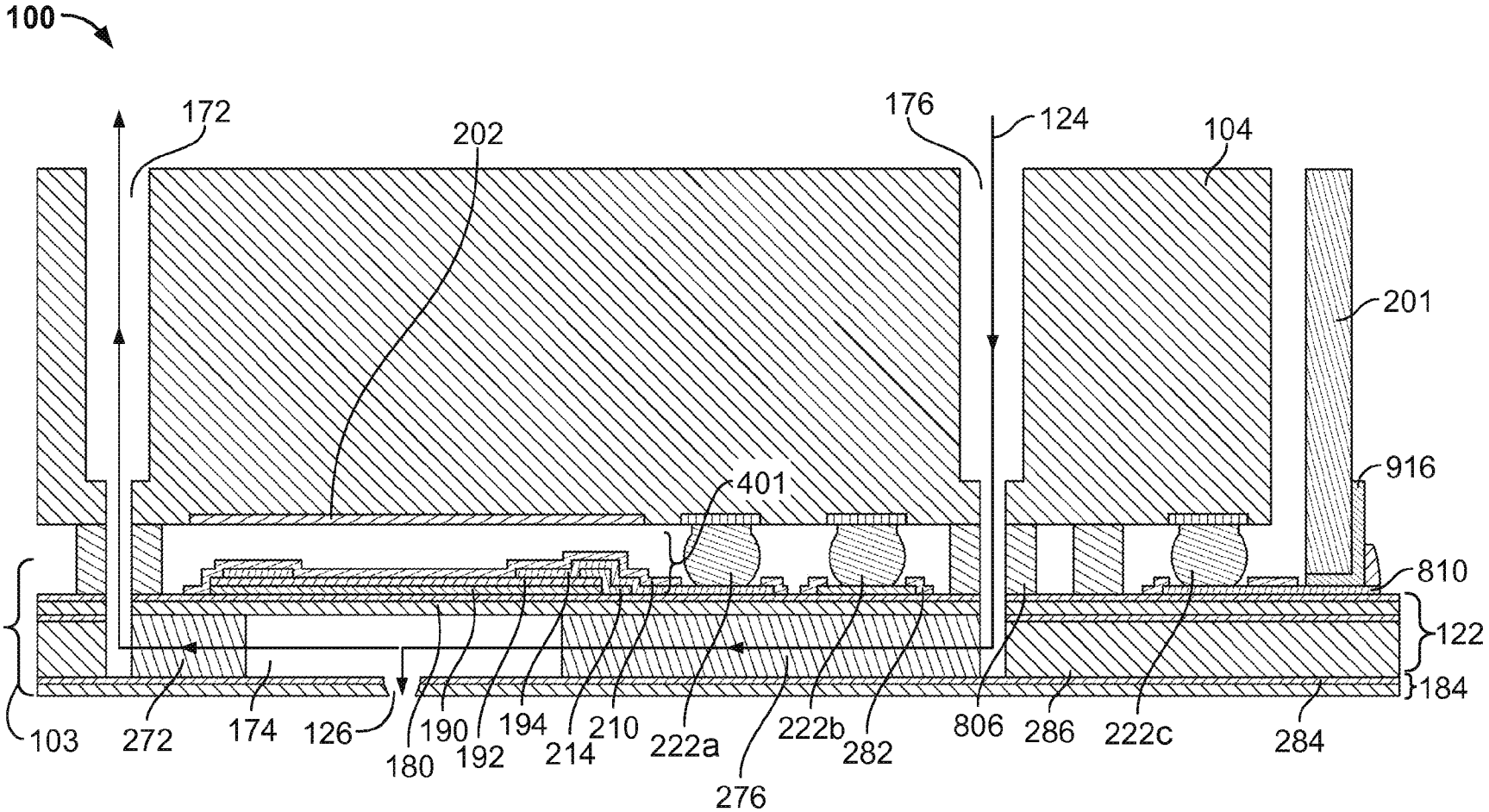
FIG. 2 a schematic cross-sectional view of an exemplary fluid ejector.

Referring to FIG. 1, an exemplary fluid ejector 100 includes a fluid ejection module, e.g., a quadrilateral plate-shaped printhead module, which can be a die 103 fabricated using semiconductor processing techniques. The fluid ejector further includes an integrated circuit interposer 104 over the die 103 and a lower housing 322 discussed further below. A housing 110 supports and surrounds the die 103, integrated circuit interposer 104, and lower housing 322 and can include a mounting frame 142 having pins 152 to connect the housing 110 to a print bar. A flex circuit 201 for receiving data from an external processor and providing drive signals to the die can be electrically connected to the die 103 and held in place by the housing 110. Tubing 162 and 166 can be connected to inlet and outlet chambers 132, 136 inside the lower housing 322 (see FIG. 4) to supply fluid to the die 103. The fluid ejected from the fluid ejector 100 can be ink, but the fluid ejector 100 can be suitable for other liquids, e.g., biological liquids, polymers, or liquids for forming electronic components Referring to FIG. 2, the fluid ejector 100 can include a substrate 122, e.g. a silicon-on-insulator (SOI) wafer that is part of the die 103, and the integrated circuit interposer 104. The integrated circuit interposer 104 includes transistors 202 (only one ejection device is shown in FIG. 2 and thus only one transistor is shown) and is configured to provide signals for controlling ejection of fluid from the nozzles 126. The substrate 122 and integrated circuit interposer 104 include multiple fluid flow paths 124 formed therein. A single fluid path 124 includes an inlet channel 176 leading to a pumping chamber 174. The pumping chamber 174 leads to both a nozzle 126 and an outlet channel 172. The fluid path 124 further includes a pumping chamber inlet 276 and a pumping chamber outlet 272 that connect the pumping chamber 174 to the inlet channel 176 and outlet channel 172, respectively. The fluid path can be formed by semiconductor processing techniques, e.g. etching. In some embodiments, deep reactive ion etching is used to form straight walled features that extend part way or all the way through a layer in the die 103. In some embodiments, a silicon layer 286 adjacent to an insulating layer 284 is etched entirely through using the insulating layer as an etch stop. The die 103 can include a membrane 180, which defines one wall of and seals an interior of the pumping chamber 174 from being exposed to an actuator, and a nozzle layer 184 in which the nozzle 126 is formed. The nozzle layer 184 can be on an opposite side of the insulating layer 284 from the pumping chamber 174. The membrane 180 can be formed of a single layer of silicon. Alternatively, the membrane 180 can include one or more layers of oxide or can be formed of aluminum oxide ($AlO_2$), nitride, or zirconium oxide ($ZrO_2$).

The fluid ejector 100 also includes individually controllable actuators 401 supported by the substrate 122. Multiple actuators 401 are considered to form an actuator layer 324 (see FIG. 3), where the actuators can be electrically and physically separated from one another but part of a layer, nonetheless. The substrate 122 includes an optional layer of insulating material 282, such as oxide, between the actuators and the membrane 180. When activated, the actuator cause fluid to be selectively ejected from the nozzles 126 of corresponding fluid paths 124. Each flow path 124 with its associated actuator 401 provides an individually controllable MEMS fluid ejector unit. In some embodiments, activation of the actuator 401 causes the membrane 180 to deflect into the pumping chamber 174, reducing the volume of the pumping chamber 174 and forcing fluid out of the nozzle 126. The actuator 401 can be a piezoelectric actuator and can include a lower electrode 190, a piezoelectric layer 192, and an upper electrode 194. Alternatively, the fluid ejection element can be a heating element.

Figure 3:
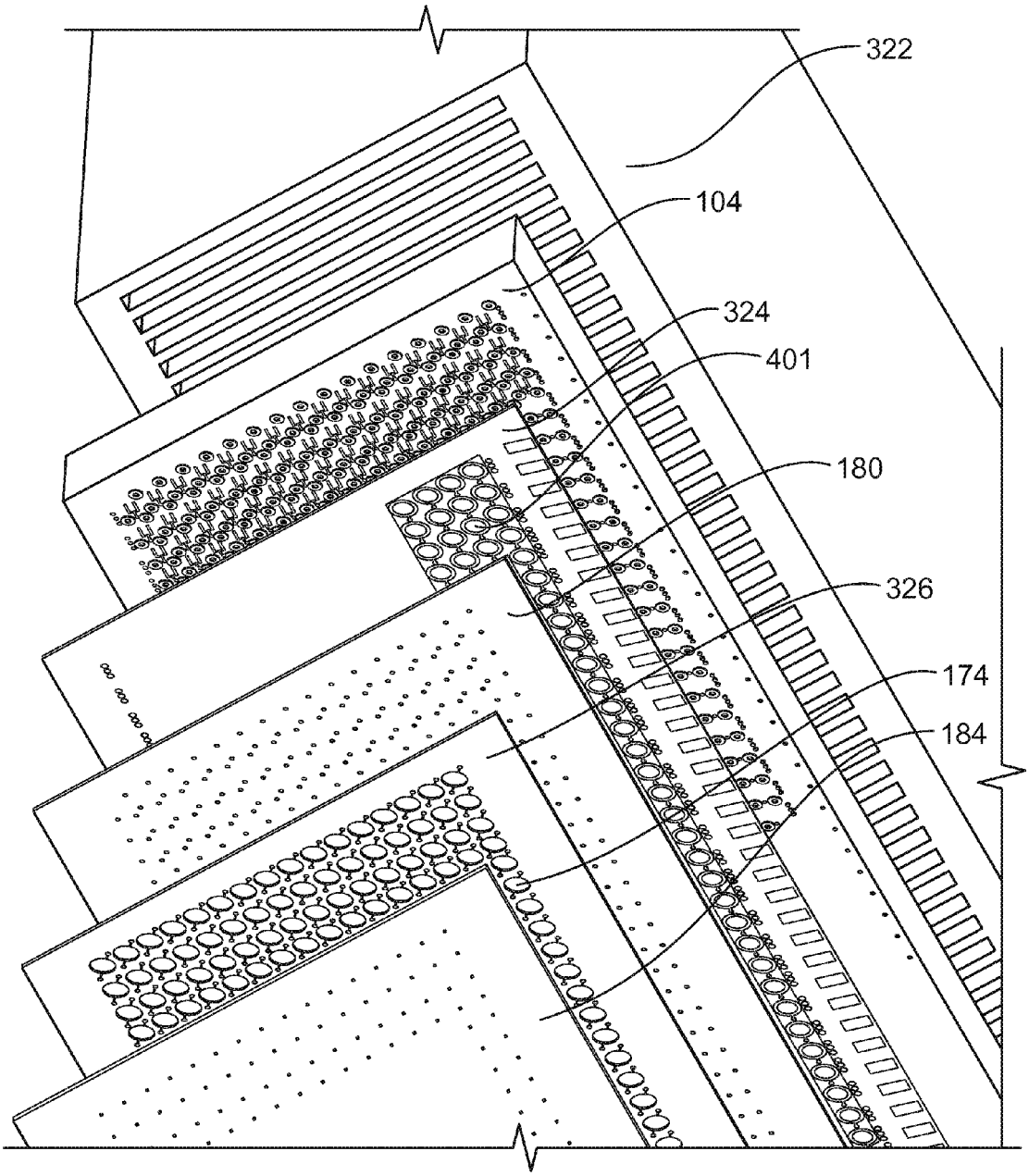
FIG. 3 is an exploded perspective partial bottom view of an exemplary fluid ejector.

As shown in FIG. 3, the fluid ejector 100 can include multiple layers stacked vertically. A lower housing 322 can be bonded to the integrated circuit interposer 104. The integrated circuit interposer 104 can be bonded to the actuator layer 324. The actuator layer 324 can be attached to the membrane 180. The membrane 180 can be attached to a pumping chamber layer 326. The pumping chamber layer 326 can be attached to the nozzle layer 184. Generally, the layer includes a similar material or similar elements that occur along a plane. All of the layers can be approximately the same width, for example, each layer can have a length and a width that are at least 80% of the length and the width of another layer in the fluid ejector 100. Although not shown in FIG. 3, the housing 110 can at least partially surround the vertically stacked layers.

Figure 4:
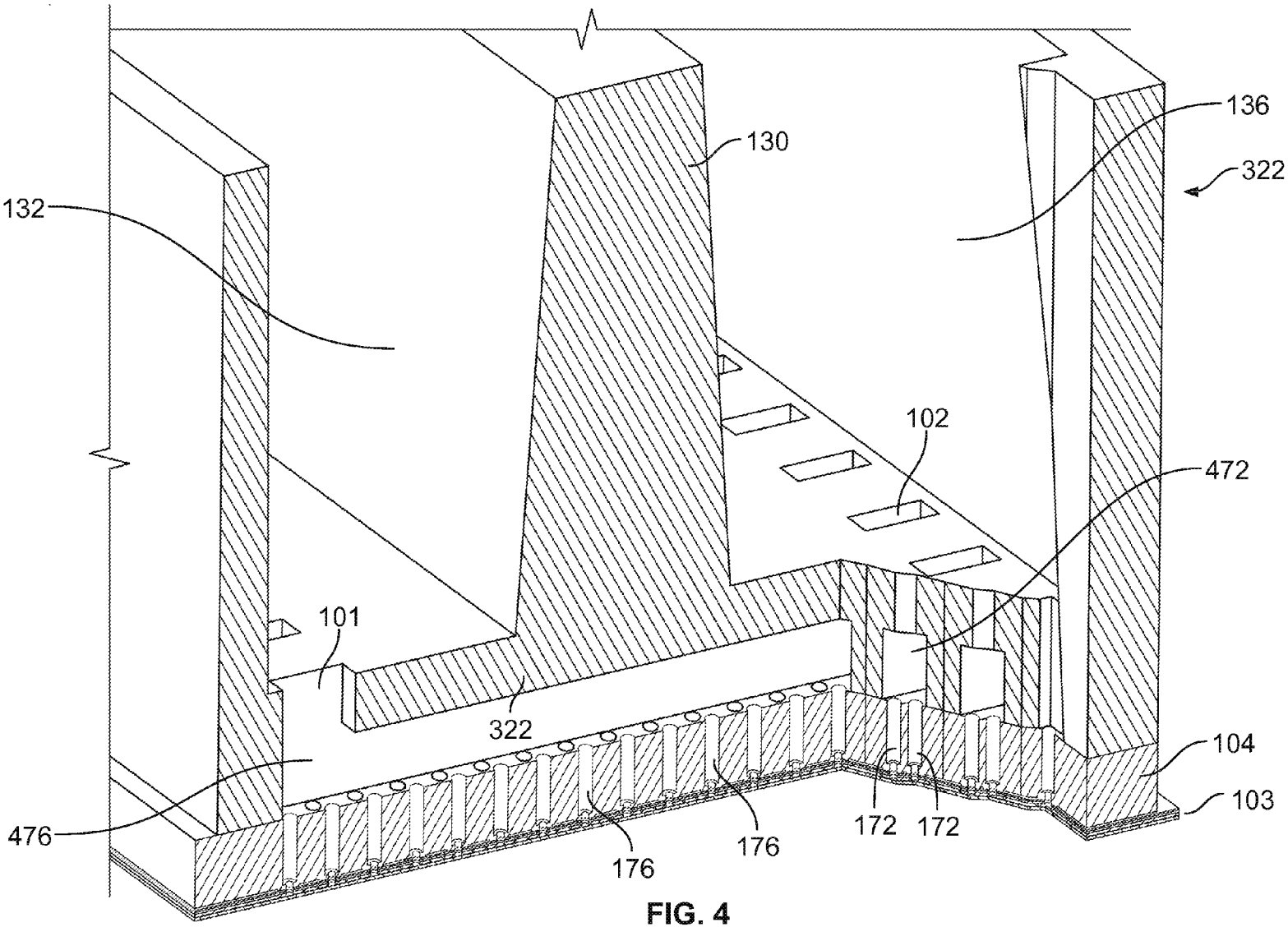
FIG. 4 is a perspective sectional view of an exemplary fluid ejector.

Referring to FIG. 4, fluid can flow from the fluid supply through the lower housing 322, through the integrated circuit interposer 104, through the substrate 103, and out of the nozzles 126 in the nozzle layer 184. The lower housing 322 can be divided by a dividing wall 130 to provide an inlet chamber 132 and an outlet chamber 136. Fluid from the fluid supply can flow into the fluid inlet chamber 132, through fluid inlets 101 in the floor of the lower housing 322, through fluid inlet passages 476 of the lower housing 322, through the fluid paths 124 of the fluid ejection module 103, through fluid outlet passages 472 of the lower housing 322, out through the outlet 102, into the outlet chamber 136, and to the fluid return. A portion of the fluid passing through the fluid ejection module 103 can be ejected from the nozzles 126.

Each fluid inlet 101 and fluid inlet passage 476 is fluidically connected in common to the parallel inlet channels 176 of a number of MEMS fluid ejector units, such as one, two or more rows of units. Similarly, each fluid outlet 102 and each fluid outlet passage 472 is fluidically connected in common to the parallel outlet channels 172 of a number of MEMS fluid ejector units, such as one, two or more rows of units. Each fluid inlet chamber 132 is common to multiple fluid inlets 101. And each fluid outlet chamber 136 is common to multiple outlets 102.

Figure 5:
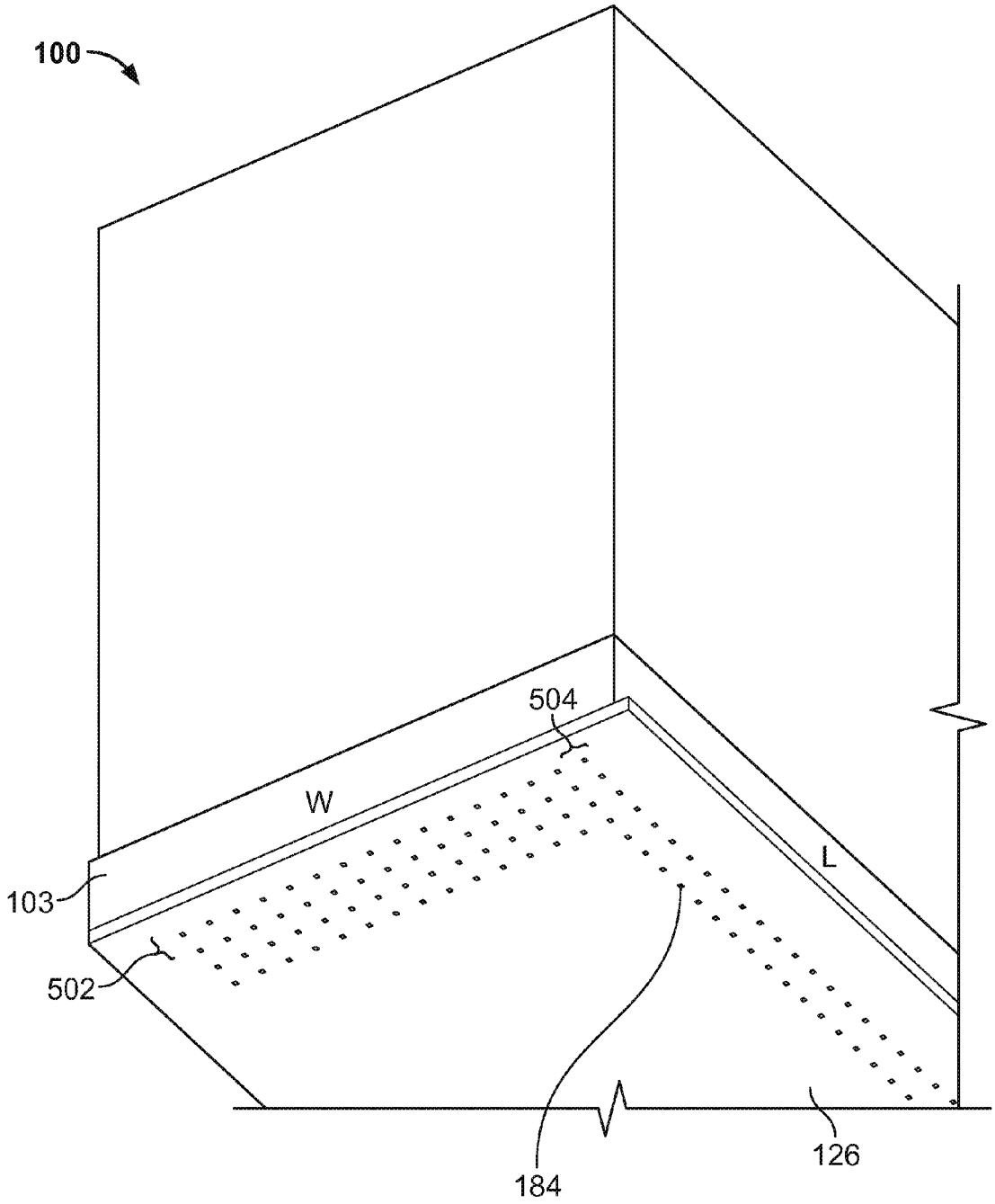
FIG. 5 is a bottom perspective view of an exemplary fluid ejector showing a nozzle layer.

Referring to FIG. 5, the nozzle layer 184 can include a matrix or array of nozzles 126. In some embodiments, the nozzles 126 are arranged in straight parallel rows 504 and parallel columns 502. As used herein, a column is the set of nozzles aligned closer to an axis that is parallel to the print direction than perpendicular to the print direction. However, the columns 502 need not be exactly parallel to the print direction, but rather might be offset by an angle that is less than 45°. Further, a row is the set of nozzles aligned closer to an axis that is perpendicular to the print direction than parallel to the print direction. Likewise, the rows 504 need not be exactly perpendicular to the print direction, but rather might be offset by an angle that is less than 45°. The columns 502 can extend approximately along a width W of the nozzle layer 184, while the rows 504 can extend approximately along a length L of the nozzle layer 184.

The number of columns 502 in the matrix can be greater than the number of rows 504. For example, there can be less than 20 rows and more than 50 columns, e.g. 18 rows and 80 columns. The nozzles 126 of each row 504 can be equally spaced from adjacent nozzles in the row. Likewise, the nozzles 126 of each column can be equally spaced from adjacent nozzles in the column. Further, the rows and columns need not be aligned perpendicularly. Rather, an angle between the rows and columns can be less than 90°. The rows and/or columns may not be perfectly spaced apart. Moreover, the nozzles 126 may not lie along a straight line in the row and/or columns.

The nozzle matrix can be a high density matrix, e.g. have between 550 and 60,000 nozzles, for example 1,440 or 1,200 nozzles, in an area that is less than one square inch. As discussed further below, this high density matrix can be achieved because, for example, a separate integrated circuit interposer 104 includes the logic to control the actuators, allowing the pumping chambers, and hence the nozzles, to be spaced more closely together. That is, the membrane layer can be substantially free of electrically connections running across the membrane.

The area containing the nozzles 126 can have a length L greater than one inch, e.g. the length L of the nozzle layer can be about 34 mm, and a width W of the nozzle layer can be less than one inch, e.g. about 6.5 mm. The nozzle layer can have a thickness of between 1 μm and 50 μm, such as 20-40 μm, for example 30 μm. Further, the nozzle layer can be shaped as a quadrilateral or a parallelogram. The nozzles 126 can be KOH-etched and can be square or circular.

When a media is passed below a print bar, the nozzles of the high density matrix can eject fluid onto the media in a single pass in order to form a line of pixels on the media with a high density, or print resolution, greater than 600 dpi, such as 1200 dpi or greater. To obtain a density of 1200 dpi or greater, fluid droplets that are between 0.01 pL and 10 pL in size, such as 2 pL can be ejected from the nozzles. The nozzles can be between 1 μm and 20 μm wide, such as between 10 μm and 20 μm, for example around 15 μm or 15.6 μm wide.

The nozzle layer 184 can be formed of silicon. In other embodiments, the nozzle layer 184 can be formed of a polyimide or photodefinable film, such as a photopolymer, dry film photoresist, or photodefinable polyimide, which can advantageously be patterned by photolithography such that etching need not be required.

Figure 6:
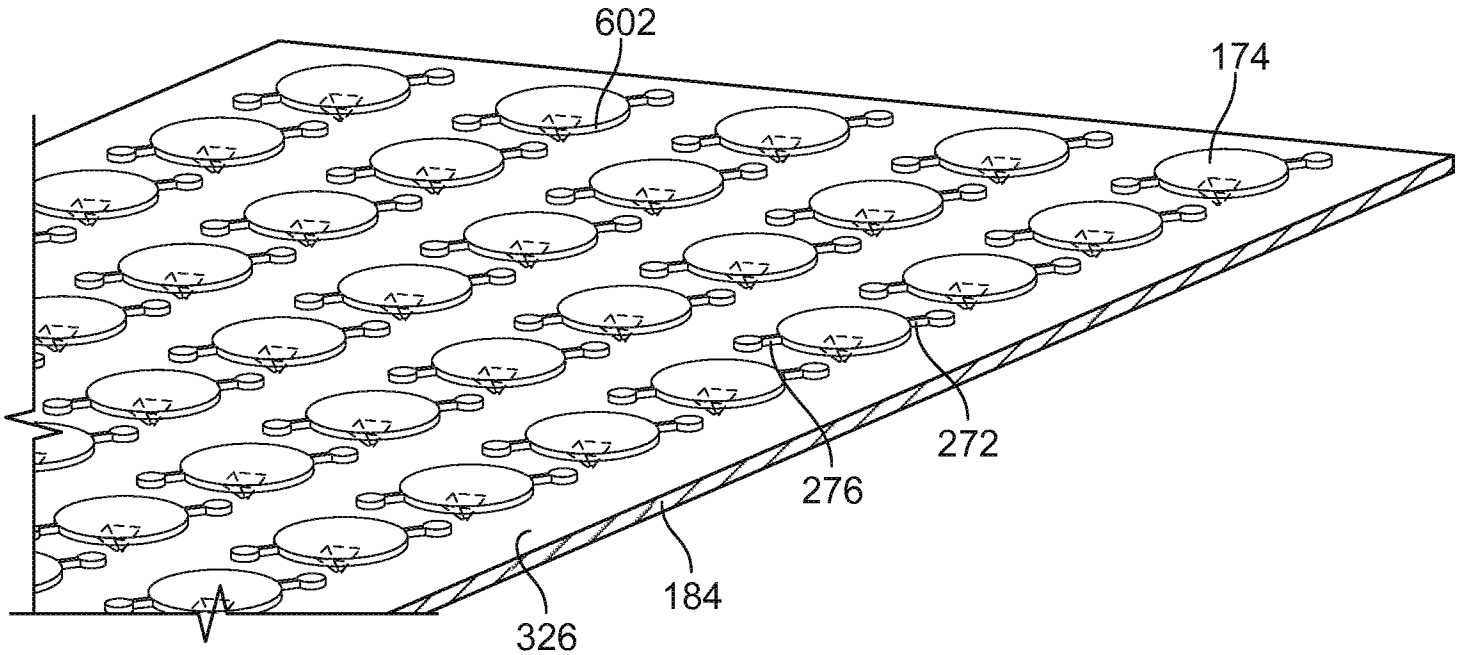
FIG. 6 is a top perspective view of a pumping chamber layer of an exemplary fluid ejector.

Referring to FIG. 6, a pumping chamber layer 326 can be adjacent to, e.g. attached to, the nozzle layer 184. The pumping chamber layer 326 includes pumping chambers 174. Each pumping chamber 174 can be a space with at least one deformable wall that forces liquid out of an associated nozzle. The pumping chambers can have a shape that provides that highest possible packing density. Shown in FIG. 6, the pumping chambers 174 can be approximately circular in shape and can be generally defined by side walls 602. The pumping chamber may not be exactly circular, that is, the shape quasi-circular and may be elliptical, oval or have a combination of straight and curved sides, such as hexagonal, octagonal, or polygonal. Further, the pumping chamber can be between about 100 μm to 400 μm, such as about 125 μm to 250 μm, along a longest width. The height of the pumping chamber 174 can be less than 50% of the shortest width of the pumping chamber.

Figure 6A:
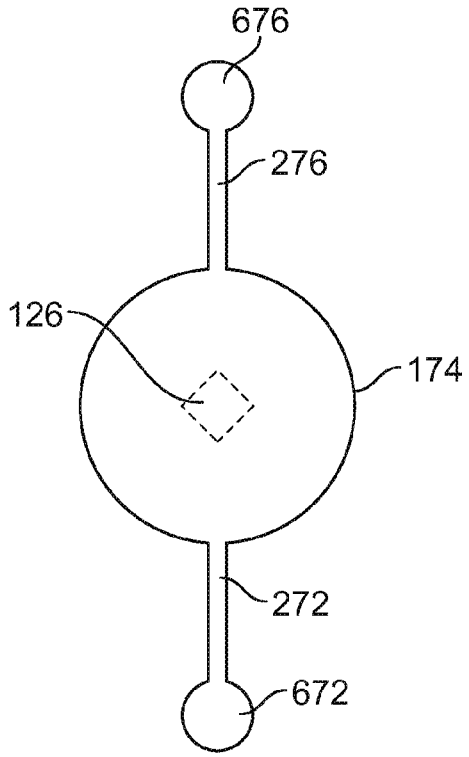
FIG. 6A is a close-up top view of a pumping chamber.

Each pumping chamber can have a pumping chamber inlet 276 and a pumping chamber outlet 272 extending therefrom and formed in the pumping chamber layer 326. The pumping chamber inlet 276 and pumping chamber outlet 272 can extend along the same plane as the pumping chamber 174 and can run along the same axis as one another. The pumping chamber inlets 276 and outlets 272 can have a much smaller width than the pumping chamber 174, where the width is the smallest non-height dimension of the inlet or outlet. The width of the pumping chamber inlets 276 and outlets 272 can be less than 30%, such as less than 10% of the width of the pumping chamber 174. The pumping chamber inlets 276 and pumping chamber outlets 272 can include parallel walls extending from the pumping chamber 174, where the distance between the parallel walls is the width. As shown in FIG. 6A, the shape of the pumping chamber inlet 276 can be the same as the pumping chamber outlet 272.

The pumping chamber layer does not include channels separate from the pumping chamber inlets 276 and outlets 272 and the inlet channel 172 and outlet channel 172. In other words, aside from the pumping chamber inlets 276 and pumping chamber outlets 272, no fluid passages run horizontally through the pumping chamber layer. Likewise, aside from the inlet and outlet channels 176 and 172, no fluid passages run vertically through the pumping chamber layer. The pumping chamber layer 326 does not include a descender, that is, a channel running from the pumping chamber 174 to the nozzle 126. Rather, the pumping chamber 174 directly abuts the nozzle 126 in the nozzle layer 184. Moreover, the inlet channel 176 runs approximately vertically through the die 103 to intersect with the pumping chamber inlet 276. The pumping chamber inlet 276 in turn runs horizontally through the pumping chamber layer 326 to fluidically connect with the pumping chamber 174. Likewise, the outlet channel 172 runs approximately vertically through the die 103 to intersect with the pumping chamber outlet 272.

As shown in FIG. 6A, in plan view, the portions 672 and 676 of the pumping chamber inlet 276 and outlet 272 that intersect with the fluid inlet 176 and fluid outlet 172 can be larger or greater in width or diameter than the rest of the pumping chamber inlet 276 and pumping chamber outlet 272. Further, the portions 672 and 676 can have a shape that is approximately circular, i.e. the inlet channels 176 and outlet channels 172 can have a tubular shape. Further, an associated nozzle 126 can be centered and directly underneath the pumping chamber 174.

Returning to FIG. 6, the pumping chambers 174 can be arranged in a matrix having rows and columns. An angle between the columns and rows can be less than 90°. There can be between 550 and 60,000 pumping chambers, for example 1,440 or 1,200 pumping chambers, in a single die, for example in an area that is less than one square inch. The height of the pumping chamber can be less than 50 μm, for example 25 μm. Further, referring back to FIG. 2, each pumping chamber 174 can be adjacent to a corresponding actuator 401, e.g., aligned with and directly below the actuator 401. The pumping chamber can extend through a distance that is at least 80% of a distance from the corresponding actuator to the nozzle.

Like the nozzle layer 184, the pumping chamber layer 326 can be formed of silicon or a photodefinable film. The photodefinable film can be, for example, a photopolymer, a dry film photoresist, or a photodefinable polyimide.

Figure 7:
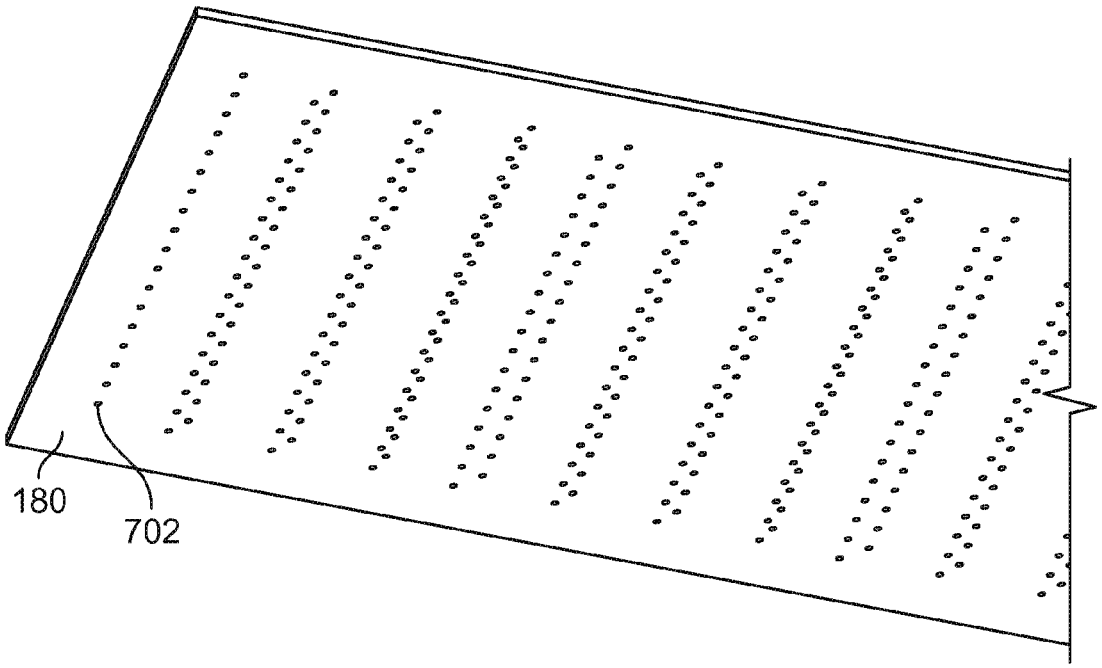
FIG. 7 is a top view of a membrane layer of an exemplary fluid ejector.

A membrane layer 180 can be adjacent to, e.g. attached to, the pumping chamber layer 326. Referring to FIG. 7, the membrane layer 180 can include apertures 702 therethrough. The apertures can be part of the fluid paths 124. That is, the inlet channel 176 and the outlet channel 172 can extend through the apertures 702 of the membrane layer 180. The apertures 702 can thus form a matrix having rows and columns. The membrane layer 180 can be formed of, for example, silicon. The membrane can be relatively thin, such as less than 25 μm, for example about 12 μm.

An actuator layer 324 can be adjacent to, e.g. attached to, the membrane layer 180. The actuator layer includes actuators 401. The actuators can be heating elements. Alternatively, the actuators 401 can be piezoelectric elements, as shown in FIGS. 2, 8, and 9.

Figure 8:
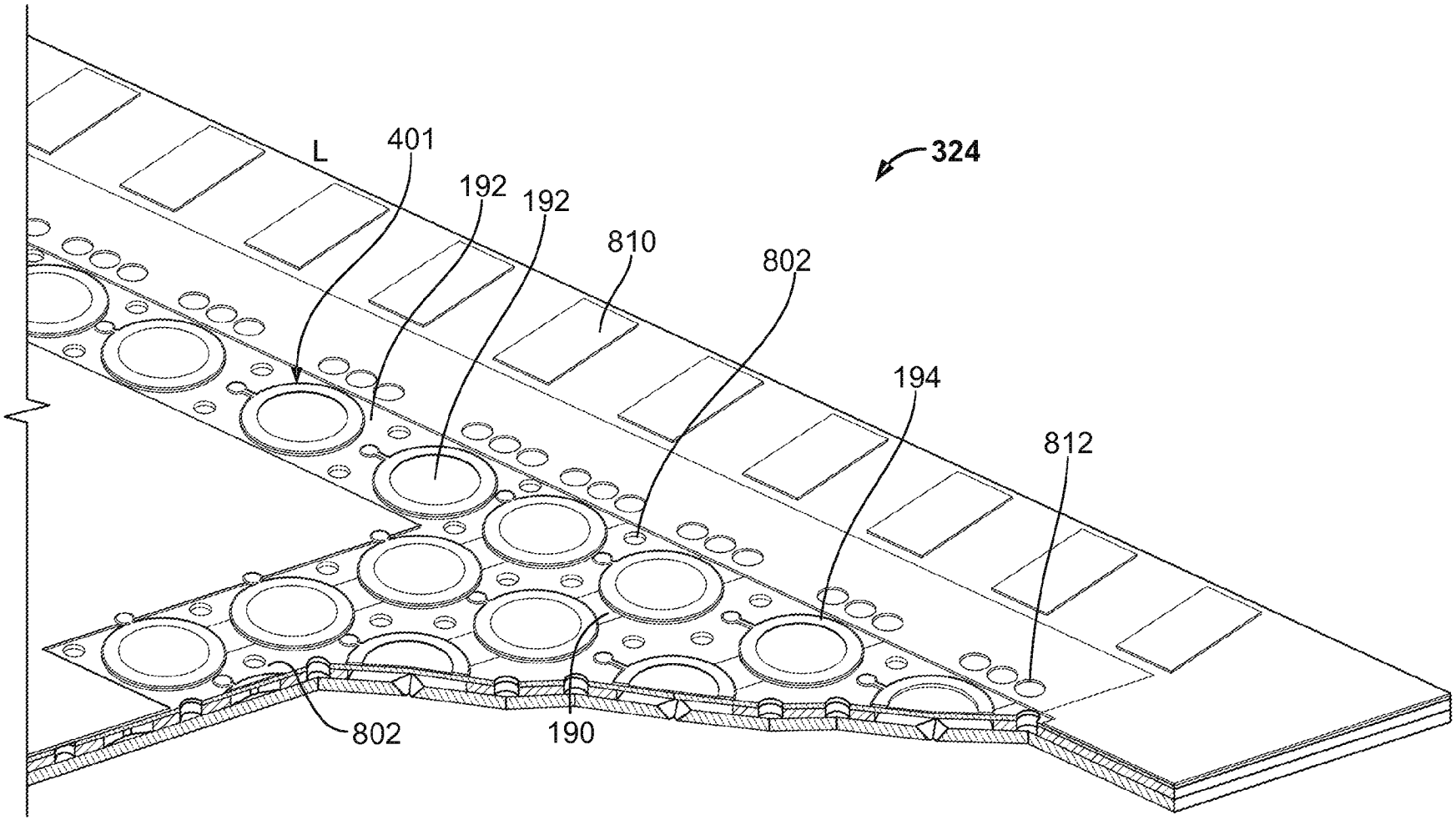
FIG. 8 is a cross-sectional perspective view of an embodiment of an actuator layer of an exemplary fluid ejector.
Figure 9:
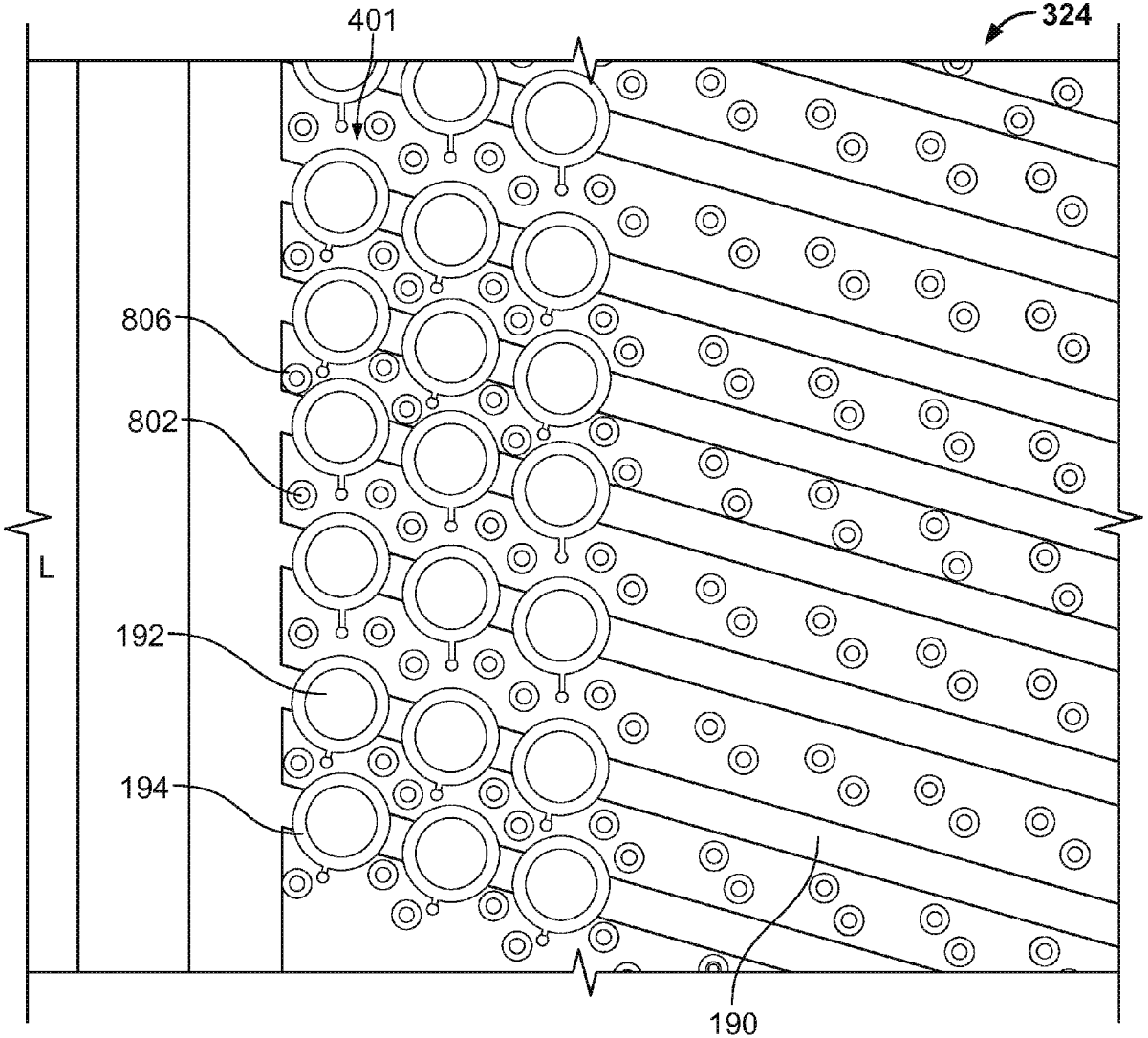
FIG. 9 is a top view of an alternate embodiment of an actuator layer of an exemplary fluid ejector.

As shown in FIGS. 2, 8, and 9, each actuator 401 includes a piezoelectric layer 192 between two electrodes, including a lower electrode 190 and an upper electrode 194. The piezoelectric layer 192 can be, for example, a lead zirconium titinate ("PZT") film. The piezoelectric layer 192 can be between about 1 and 25 microns thick, such as between about 1 μm and 4 μm thick. The piezoelectric layer 192 can be from bulk piezoelectric material or formed by sputtered using a physical vapor deposition device or sol-gel processes. A sputtered piezoelectric layer can have a columnar structure while bulk and sol-gel piezoelectric layers can have a more random structure. In some embodiments, the piezoelectric layer 192 is a continuous piezoelectric layer extending across and between all of the actuators, as shown in FIG. 8. Alternatively, as shown in FIGS. 2 and 9, the piezoelectric layer can be segmented so that the piezoelectric portions of adjacent actuators do not touch each other, e.g., there is a gap in the piezoelectric layer separating adjacent actuators. For example, the piezoelectric layers 192 can be islands formed in an approximately circular shape. The individually formed islands can be produced by etching. As shown in FIG. 2, a bottom protective layer 214, such as an insulating layer, e.g. SU8 or oxide, can be used to keep the upper and lower electrodes from contacting one another if the piezoelectric layer 192 is not continuous. A top protective layer 210, such as an insulating layer, e.g. SU8 or oxide, can be used to protect the actuator during further processing steps and/or from moisture during operation of the module.

The upper electrode 194, which in some embodiments is a drive electrode layer, is formed of a conductive material. As a drive electrode, the upper electrode 194 is connected to a controller to supply a voltage differential across the piezoelectric layer 192 at the appropriate time during the fluid ejection cycle. The upper electrode 194 can include patterned conductive pieces. For example, as shown in FIGS. 8 and 9, the top electrode 194 can be a ring electrode. Alternatively, the top electrode 194 can be a central electrode or a dual electrode incorporating both inner and ring electrodes.

The lower electrode 190, which in some embodiments is a reference electrode layer, is formed of a conductive material. The lower electrode 190 can provide a connection to ground. The lower electrode can be patterned directly on the membrane layer 180. Further, the lower electrode 190 can be common to and span across multiple actuators, as shown in FIGS. 8 and 9. The upper electrode 194 and lower electrode 190 can be formed of gold, nickel, nickel chromium, copper, iridium, iridium oxide, platinum, titanium, titanium tungsten, indium tin oxide, or combinations thereof. In this embodiment, the protective layers 210 and 214 can be continuous and have holes over the pumping chamber 174 and the leads 222. Alternatively, there can be a separate lower electrode 190 for each actuator 401. In such a configuration, as shown in FIG. 2, the protective layers 210 and 214 can be placed only around the edges of the actuators 401. As shown in FIG. 8, ground apertures 812 can be formed through the piezoelectric layer 192 for connecting to ground. Alternatively, as shown in FIG. 9, the PZT can be etched away such that the ground connection can be made anywhere along the lower electrode 190, e.g. along the portion of the lower electrode 190 that runs parallel to the length L of the actuator layer 324.

The piezoelectric layer 192 can change geometry in response to a voltage applied across the piezoelectric layer 192 between the top electrode 194 and the lower electrode 190. The change in geometry of the piezoelectric layer 192 flexes the membrane 180 which in turn changes the volume of the pumping chamber 174 and pressurizes the fluid therein to controllably force fluid through the nozzle 126.

As shown in FIG. 8, the actuator layer 324 can further include an input electrode 810 for connection to a flexible circuit, as discussed below. The input electrodes 810 extend along the length L of the actuator layer 324. The input electrode 810 can be located along the same surface of the actuator layer 324 as the upper and lower electrodes 194, 190. Alternatively, the input electrodes 810 could be located along the side of the actuator layer 324, e.g. on the thin surface that is perpendicular to the surface the bonds to the integrated circuit interposer 104.

Referring to FIGS. 8 and 9, the piezoelectric elements 401 can be arranged in a matrix of rows and columns (only some of the piezoelectric elements 401 are illustrated in FIGS. 8 and 9 so that other elements can illustrated more clearly). Apertures 802 can extend through the actuator layer 324. The apertures 802 can be part of the fluid paths 124. That is, the inlet channel 176 and the outlet channel 172 can extend through the apertures 802 of the actuator layer 324. If the piezoelectric material is etched away, as shown in FIGS. 2 and 9, a barrier material 806, such as SU8, can be placed between the membrane layer 180 and the integrated circuit interposer 104 to form the apertures 802. In other words, the barrier material 806 can be formed as bumps through which the apertures 802 can extend. As discussed below, the barrier material 806 might also be used if the piezoelectric layer is a solid layer, as shown in FIG. 8 to act as a seal to protect electronic elements from fluid leaks.

As discussed further below, the actuator layer 324 does not include traces or electrical connections running around the actuators 401. Rather, the traces to control the actuators are located in the integrated circuit interposer 104.

Figure 10:
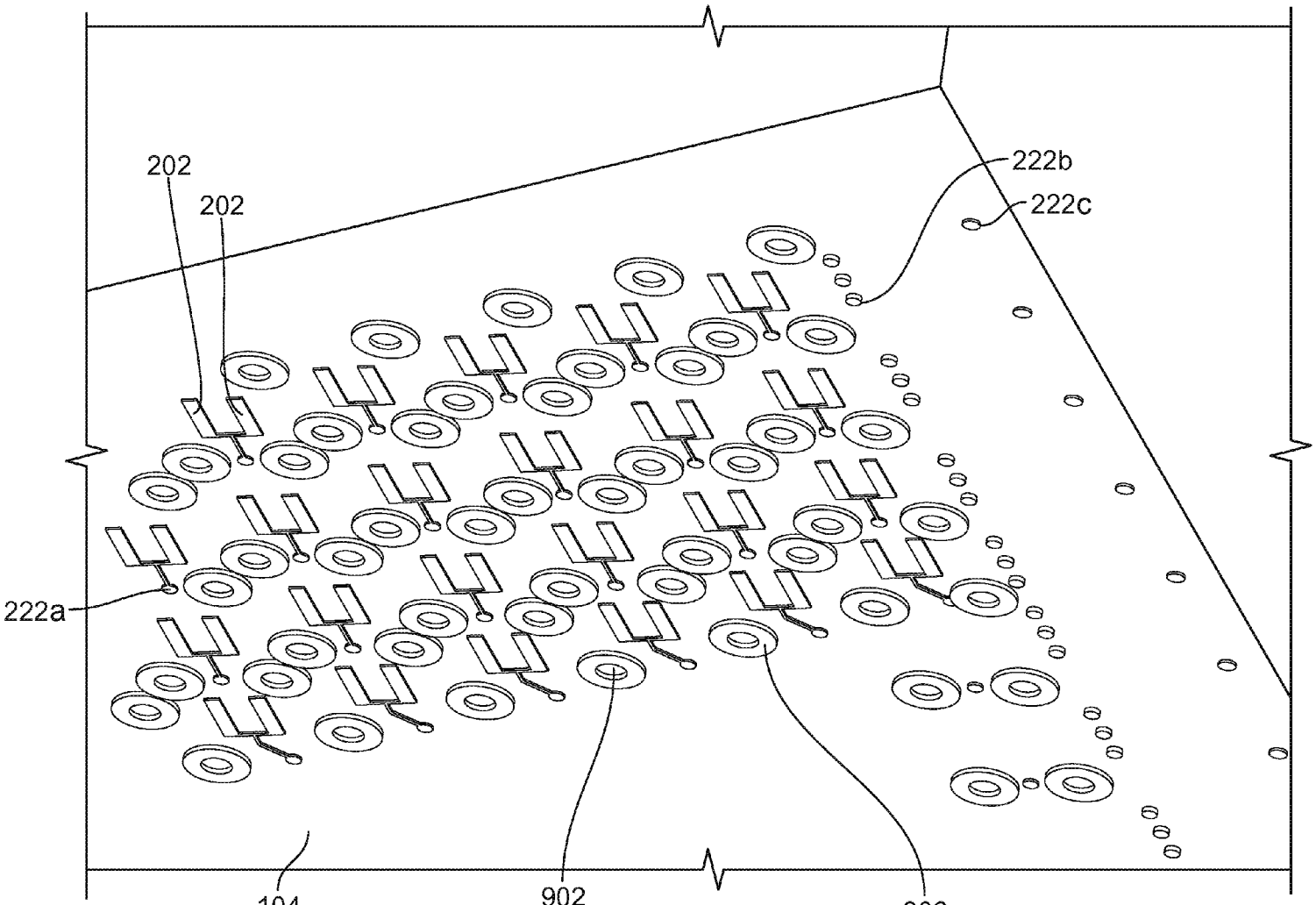
FIG. 10 is a bottom perspective view of an integrated circuit interposer of an exemplary fluid ejector.

The integrated circuit interposer 104 can be adjacent to, and in some instances attached to, the actuator layer 401. The integrated circuit interposer 104 is configured to provide signals to control the operation of the actuators 401. Referring to FIG. 10, the integrated circuit interposer 104 can be a microchip in which integrated circuits are formed, e.g. by semiconductor fabrication techniques. In some implementations, the integrated circuit interposer 104 is an application-specific integrated circuit (ASIC) element. The integrated circuit interposer 104 can include logic to provide signals to control the actuators.

Referring still to FIG. 10, the integrated circuit interposer 104 can include multiple integrated switching elements 202, such as transistors. The integrated switching elements 202 can be arranged in a matrix of rows and columns. In one embodiment, there is one integrated switching element 202 for every actuator 201. In another embodiment, there are more than one, e.g. two integrated switching elements 202 for every actuator 401. Having two integrated circuit elements 202 can be beneficial to provide redundancy, to drive part of the corresponding actuator with one transistor and another part of the actuator with the second transistor such that half of the voltage is required, or to create an analog switch to permit more complex waveforms than a single transistor. Further, if four integrated circuit elements 202 are used, redundant analog switches can be provided. A single integrated circuit element 202 or multiple integrated switching elements 202 can be located adjacent to, or on top of, the corresponding actuator 401. That is, an axis can extend through a nozzle 126 through a pumping chamber 174 and through a transistor or between the two switching elements. Each integrated switching element 202 acts as an on/off switch to selectively connect the upper electrode 194 of one of the actuators 401 to a drive signal source. The drive signal voltage is carried through internal logic in the integrated circuit interposer 104.

The integrated switching elements 202, e.g. transistors, in the integrated circuit interposer 104 can be connected to the actuators 401 through leads 222*a*, e.g. gold bumps. Further, sets of leads 222*b*, e.g. gold bumps, can be aligned along the edge of the integrated circuit interposer 104. Each set can include a number of leads 222*b*, for example three leads 222*b*. There can be one set of leads 222*b* for every column of integrated switching elements 202. The leads 222*b* can be configured to connect logic in the integrated circuit interposer 104 with the ground electrode 190 on the die 103, for example through the ground apertures 812 of the actuator layer 324. Further, there can be leads 222*c*, e.g., gold bumps, located near the edge of the integrated circuit interposer 104. The leads 222*c* can be configured to connect logic in the integrated circuit interposer 104 with the input electrode 810 for connection with the flex circuit 201, as described below. The leads 222*a*, 222*b*, 222*c* are located on a region of the substrate that is not over a pumping chamber.

As shown in FIG. 10, the integrated circuit interposer 104 can include apertures 902 therethrough. The apertures can be narrower near the side of the integrated circuit interposer 104 including the integrated switching elements 202 than at the opposite side in order to leave room for electrical connections in the layer. The apertures 902 can be part of the fluid paths 124. That is, the inlet channel 176 and the outlet channel 172 can extend through the apertures 902 of the integrated circuit interposer 104. To prevent fluid leaks between the fluid paths 124 and the electronics, such as the logic in the integrated circuit interposer 104, the fluid passages 124 can be coated with a material that provides a good oxygen barrier and has good wetting properties to facilitate transport of fluid through the passages, such as a metal, e.g. titanium or tantalum, or a non-metallic material, e.g. silicon oxide, low pressure chemical vapor deposition (LPCVD oxide), aluminum oxide, or silicon nitride/silicon oxide. The coating can be applied by electroplating, sputtering, CVD, or other deposition processes. Moreover, the barrier material 806 can be used to protect the logic in the integrated circuit element from fluid leaks. In another embodiment, a barrier layer, e.g. SU8, could be placed between the integrated circuit interposer 104 and the die 103, such as by spin-coating. The barrier layer can extend over all, or nearly all, of the length and width of the integrated circuit interposer 104 and die 103 be patterned to leave openings for the apertures 902.

The fluid ejector 100 can further include a flexible printed circuit or flex circuit 201. The flex circuit 201 can be formed, for example, on a plastic substrate. The flex circuit 201 is configured to electrically connect the fluid ejector 100 to a printer system or computer (not shown). The flex circuit 201 is used to transmit data, such as image data and timing signals, for an external process of the print system, to the die 103 for driving fluid ejection elements, e.g. the actuators 401.

Figure 11:
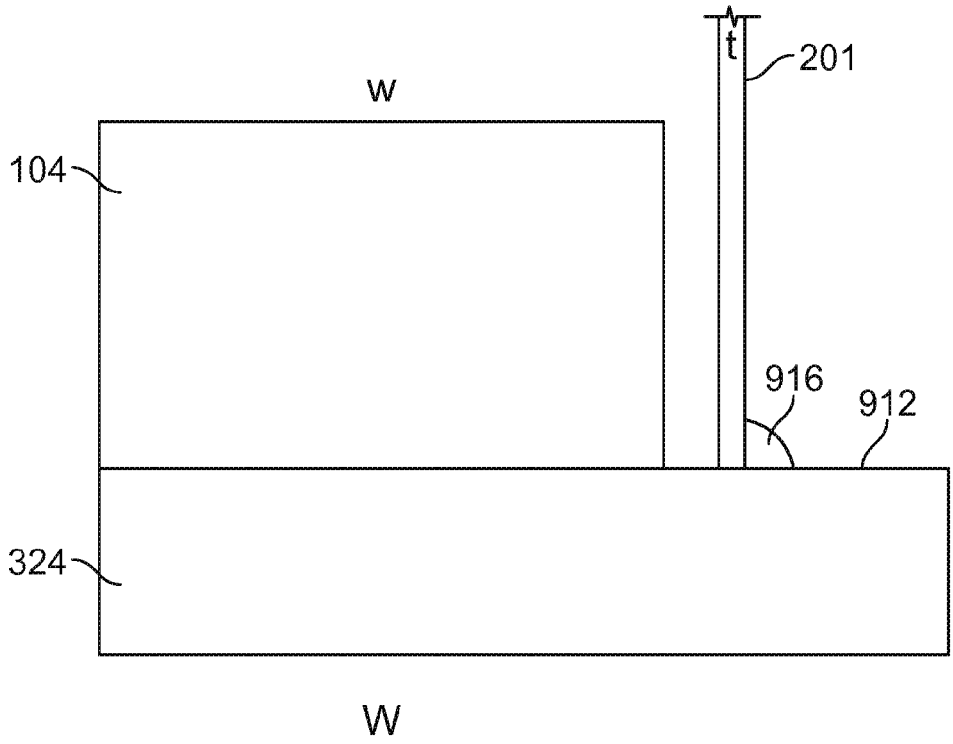
FIG. 11 is a schematic diagram of an embodiment of a flex circuit bonded to an exemplary die.
Figure 12:
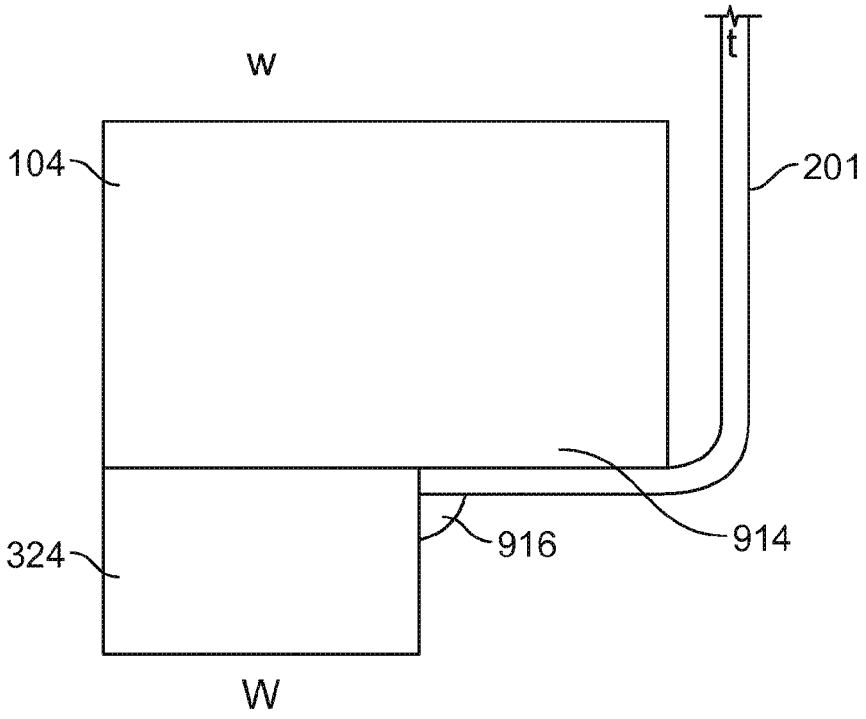
FIG. 12 is a schematic diagram of an alternate embodiment of a flex circuit bonded to an exemplary fluid ejection module.

As shown in FIGS. 11 and 12, the flex circuit 201 can be bonded to the actuator layer 324, such as with an adhesive, for example epoxy. In one embodiment, shown in FIG. 11, the actuator layer 324, can have a larger width W than the width w of the integrated circuit interposer 104. The actuator layer 324 can thus extend past the integrated circuit interposer 104 to create a ledge 912. The flex circuit 201 can extend alongside the integrated circuit interposer 104 such that the edge of the integrated circuit interposer 104 that is perpendicular to the surface contacting the actuator layer 324 extends parallel to the flex circuit 201. The flex circuit 201 can have a thickness t. The flex circuit can have a height and a width that are much larger than the thickness t. For example, the width of the flex circuit 201 can be approximately the length of the die, such as 33 mm, while the thickness t can be less than 100 μm, such as between 12 and 100 μm, such as 25-50 μm, for example approximately 25 μm. The narrowest edge, e.g. having a thickness t, can be bonded to the top surface of the actuator layer 324, e.g., to the surface of the actuator layer 324 that bonds to the integrated circuit interposer 104.

In another embodiment, shown in FIG. 12, the integrated circuit interposer 104 can have a larger width w than the width W of the die the actuator layer 324. The integrated circuit interposer 104 can thus extend past the actuator layer 324 to create a ledge 914. The flex circuit 201 can bend around the ledge 914 to attach to the interposer 104. Thus, the flex circuit 201 can extend alongside the integrated circuit interposer 104 such that the edge of the integrated circuit interposer 104 that is perpendicular to the surface contacting the actuator layer 324 extends parallel to a portion of the flex circuit 201. The flex circuit 201 can bend around the ledge 914 such that a portion of the flex circuit 201 attaches to the bottom of the integrated circuit interposer 104, i.e. to the surface that contacts the actuator layer 324. As in the embodiment of FIG. 11, the flex circuit can have a height and a width that are much larger than the thickness t. For example, the width of the flex circuit 201 can be approximately the length of the die, such as 33 mm, while the thickness t can be less than 100 μm, such as between 12 and 100 μm, such as 25-50 μm, for example approximately 25 μm. The narrowest edge, e.g. having a thickness t, can be adjacent to the actuator layer 324, e.g. to the surface of the actuator layer 324 that is perpendicular to the surface that bonds to the integrated circuit interposer 104.

Although not shown, the flex circuit 201 can be adjacent to the substrate 103 for stability. The flex circuit 201 can be in electrical connection with the input electrode 810 on the actuator layer 324. A small bead of conductive material, such as solder, can be used to electrically connect the flex circuit 201 with the input electrode 810. Further, only one flex is necessary per fluid ejector 100.

Figure 13:
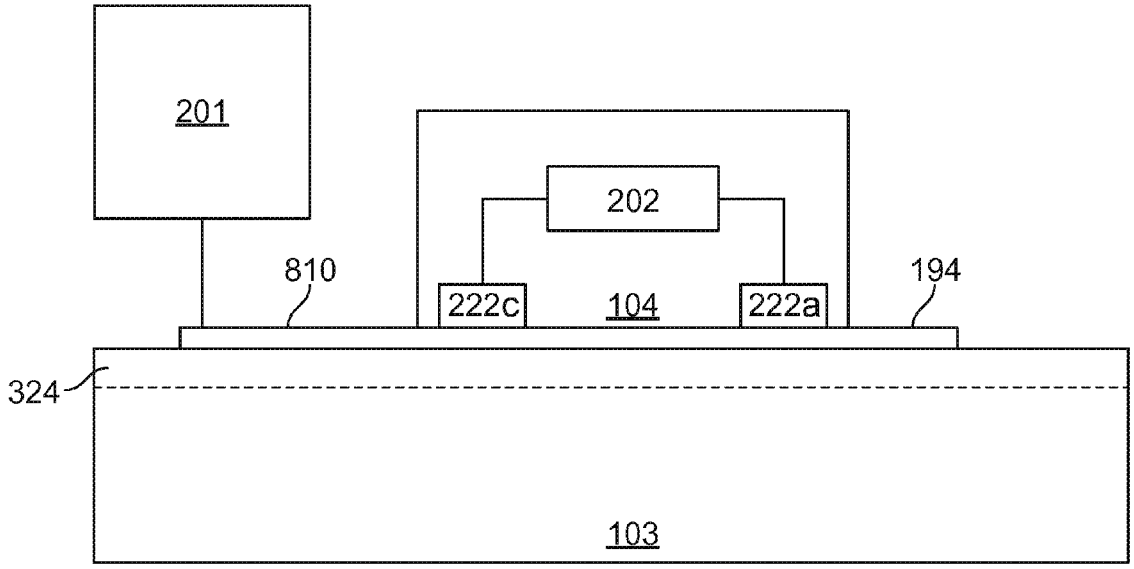
FIG. 13 is a connections diagram of a flex circuit, integrated circuit interposer, and die of an exemplary fluid ejector.

A connections diagram of the flex circuit 201, integrated circuit interposer 104, and die 103 is shown in FIG. 13. Signals from the flex circuit 201 are sent through the input electrode 810, transmitted through the leads 222*c* to the integrated circuit interposer 104, processed on the integrated circuit interposer 104, such as at the integrated circuit element 202, and output at the leads 222*a* to activate the upper electrode 194 of the actuator 401 and thus drive the actuator 401.

The integrated circuit elements 202 can include data flip-flops, latch flip-flops, OR-gates, and switches. The logic in the integrated circuit interposer 104 can include a clock line, data lines, latch line, all-on line, and power lines. A signal is processed by sending data through the data line to the data flip-flops. The clock line then clocks the data as it is entered. Data is serially entered such that the first bit of data that is entered in the first flip-flop shifts down as the next bit of data is entered. After all of the data flip-flops contain data, a pulse is sent through the latch line to shift the data from the data flip-flops to the latch flip-flops and onto the fluid ejection elements 401. If the signal from the latch flip-flop is high, then the switch is turned on and sends the signal through to drive the fluid ejection element 401. If the signal is low, then the switch remains off and the fluid ejection element 401 is not activated.

Figure 14:
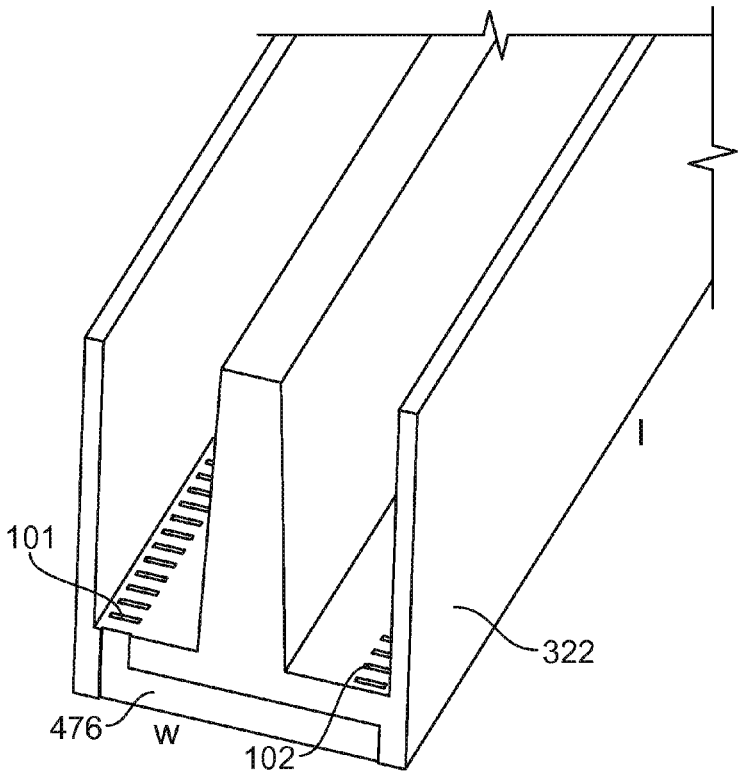
FIG. 14 is a perspective view of a housing layer of an exemplary fluid ejector.

As noted above, the fluid ejector 100 can further include a lower housing 322, shown in FIG. 14. Fluid inlets 101 and fluid outlets 102 can extend in two parallel lines along the length l of the lower housing 322. Each line, i.e. of fluid inlets 101 or fluid outlets 102, can extend near the edge of the lower housing 322.

The vertical fluid inlets 101 can lead to horizontal fluid inlet passages 476 of the lower housing 322. Likewise, the vertical fluid outlets 102 can lead to horizontal fluid outlet passages 472 (not shown in FIG. 14) of the lower housing 322. The fluid inlet passages 476 and fluid outlet passages 472 can be the same shape and volume as one another. A fluid inlet passage and inlet together can be generally "L" shaped. Further, each of the fluid inlet and fluid outlet passages 476, 472 can run parallel to one another across the width w of the lower housing 322, extending, for example, across 70-99% of the width of the housing component, such as 80-95%, or 85% of the width of the housing component. Further, the fluid inlet passages 476 and fluid outlet passages 472 can alternate across the length l of the lower housing 322.

The fluid inlet passages 476 and fluid outlet passages 472 can each extend in the same direction, i.e., along parallel axes. Moreover, as shown in FIG. 4, the fluid inlet passages 476 can each connect to multiple fluid inlet channels 176. Each fluid inlet channel 176 can extend perpendicularly from the fluid inlet passages 476. Likewise, each fluid outlet passage 472 can connect to multiple fluid outlet channels 172, each of which extends perpendicularly from the fluid outlet passage 472.

Fluid from the fluid supply can thus flow into the fluid inlet chamber 132, through fluid inlets 101 in the housing 322, through fluid inlet passages 476 of the lower housing 322, through multiple fluid paths of the fluid ejection module 103, through fluid outlet passages 472 of the lower housing 322, out through the outlet 102, into the outlet chamber 136, and to the fluid return.

Figure 15A:
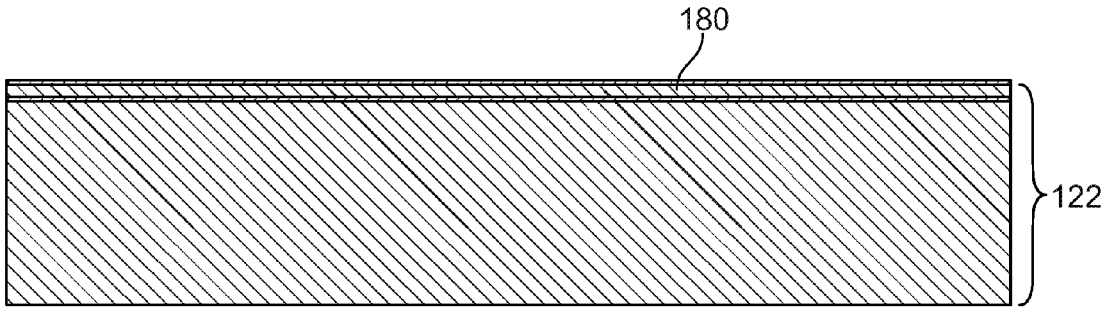
FIGS. 15A-15T are schematic diagrams showing an exemplary method for fabricating a fluid ejector.
Figure 15B:
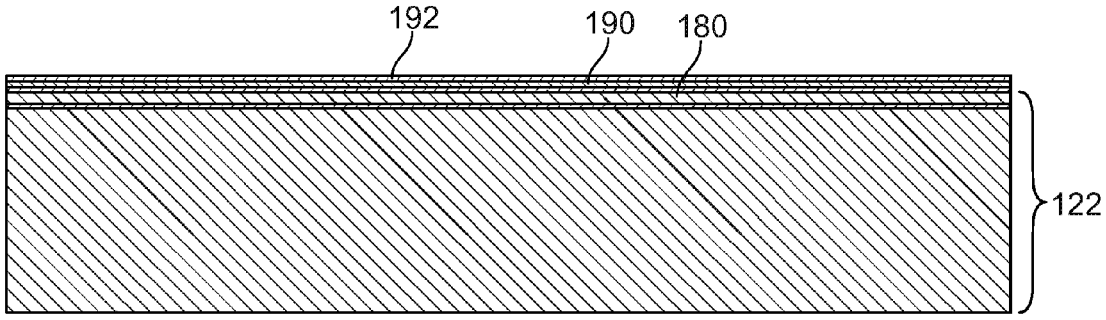
Figure 15C:
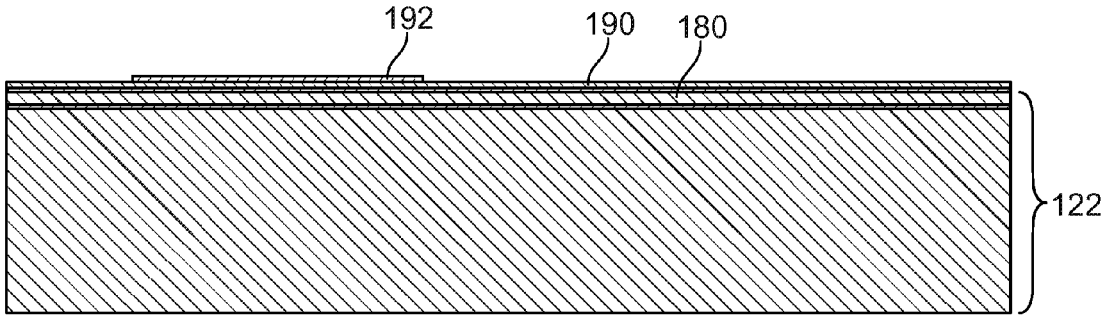
Figure 15D:
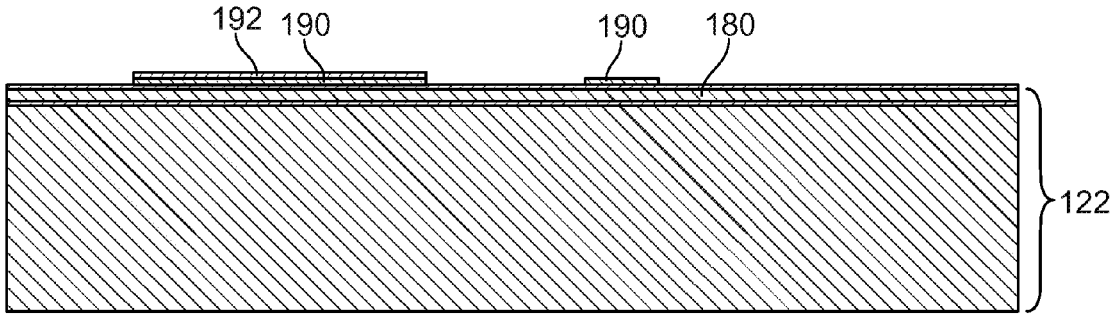
Figure 15E:
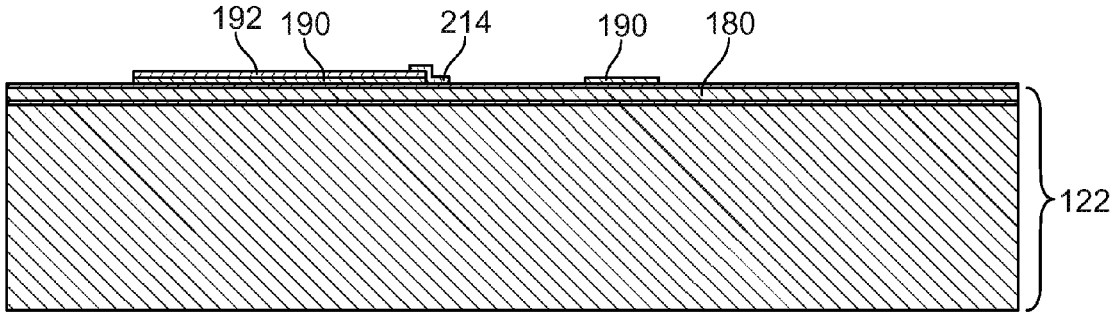
Figure 15F:
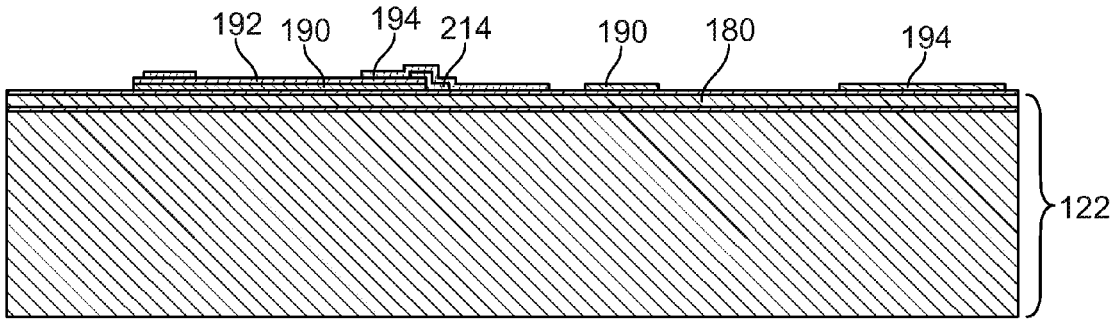
Figure 15G:
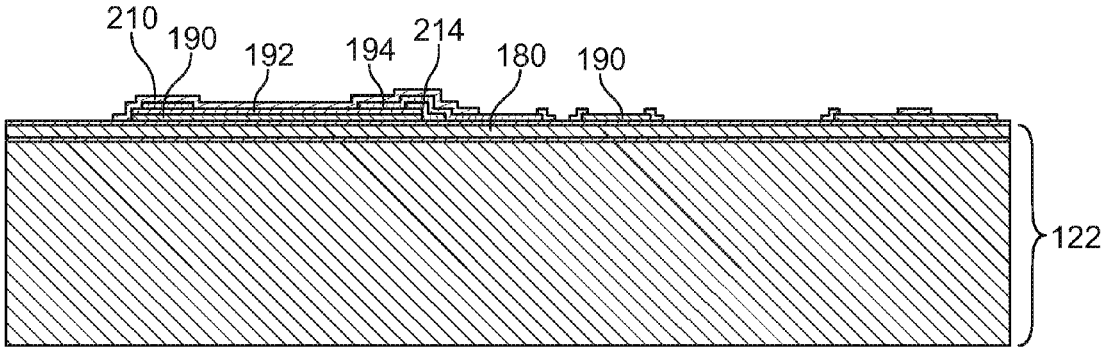
Figure 15H:
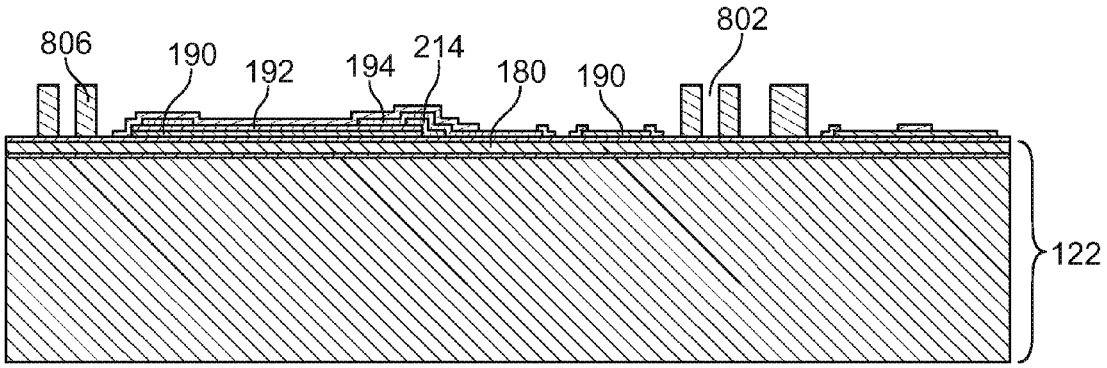
Figure 15I:
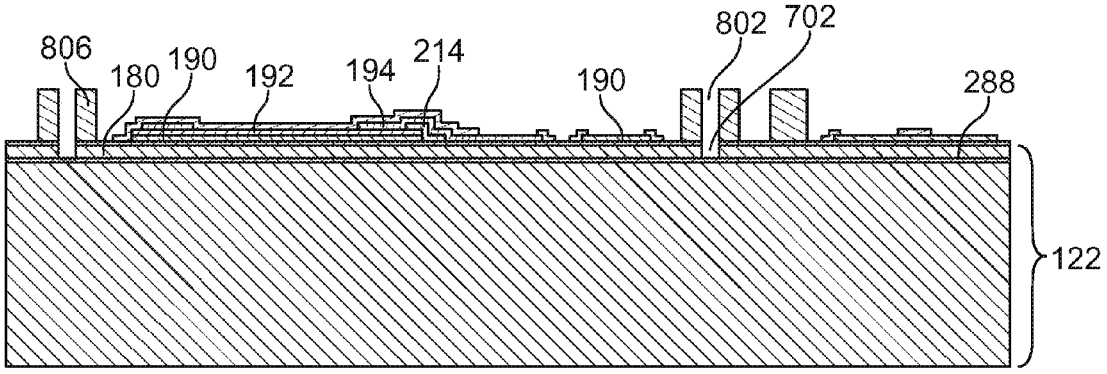
Figure 15J:
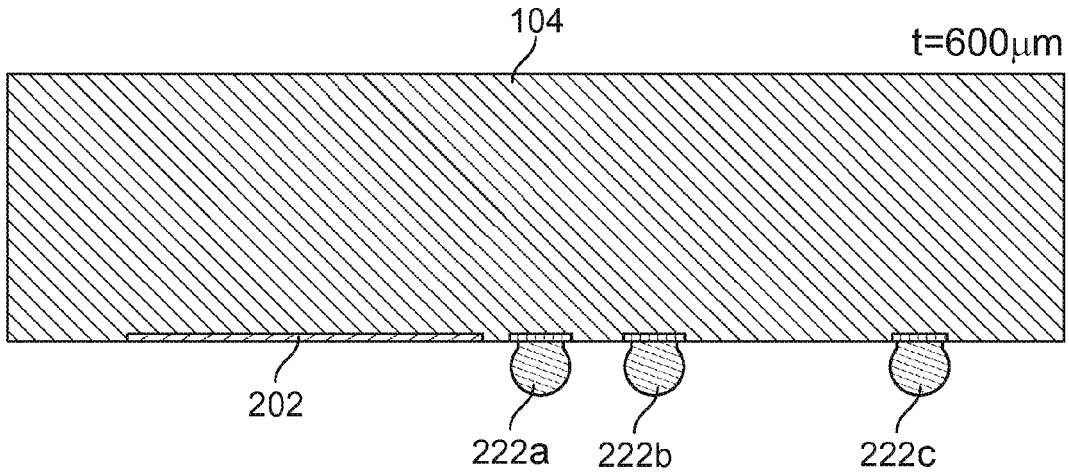
Figure 15K:
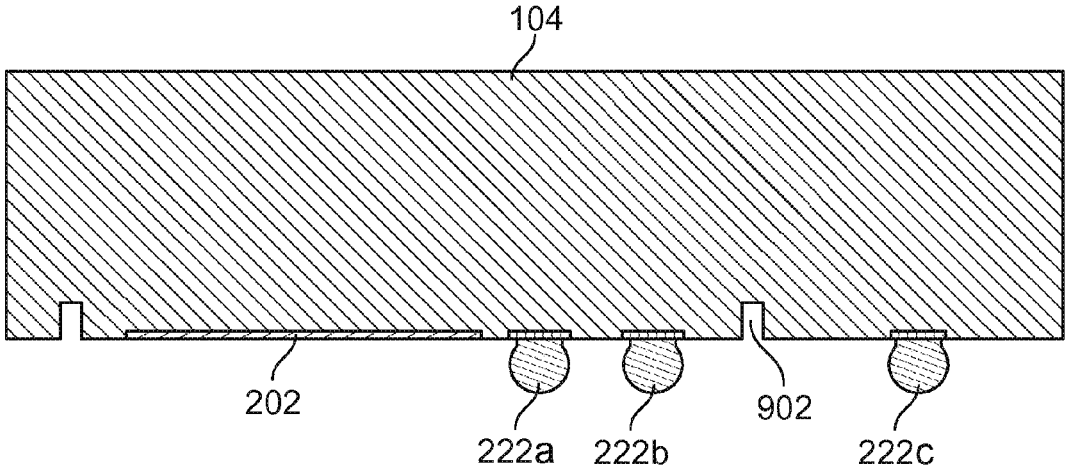
Figure 15L:
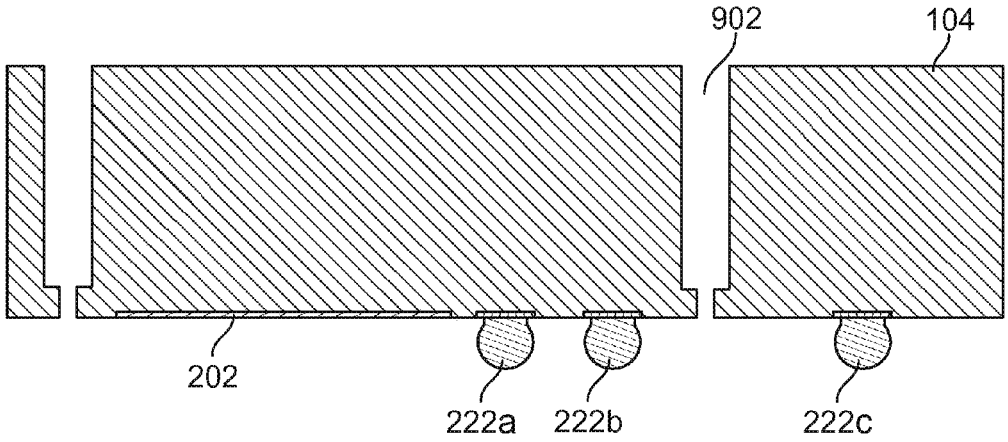
Figure 15M:
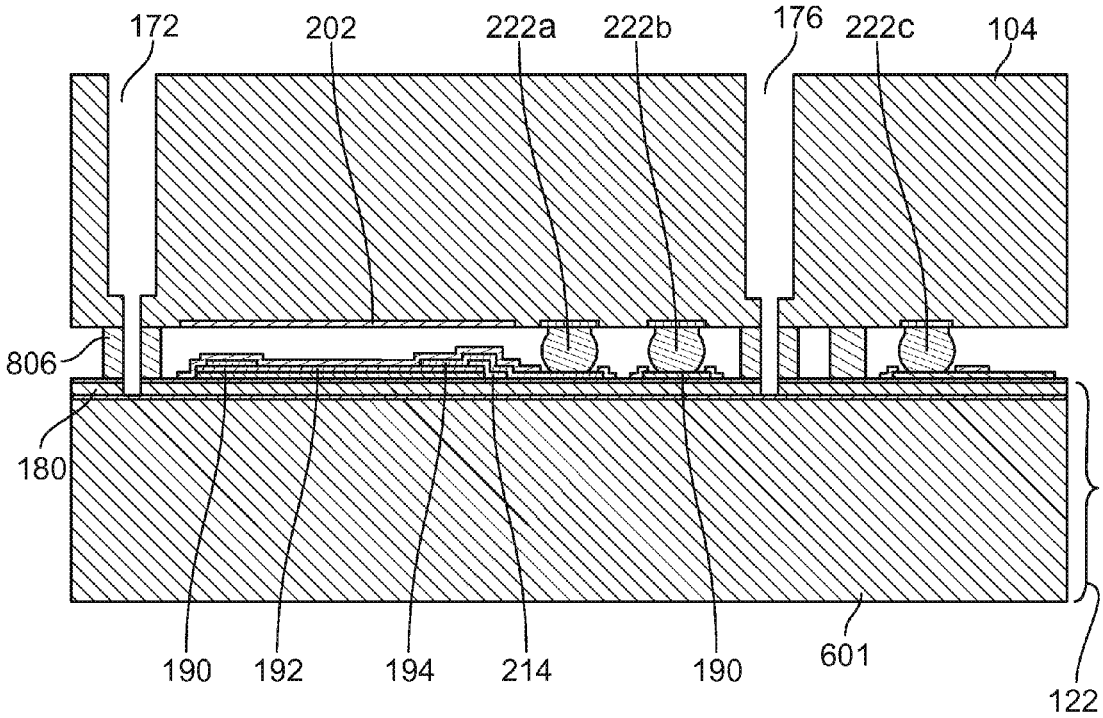
Figure 15N:
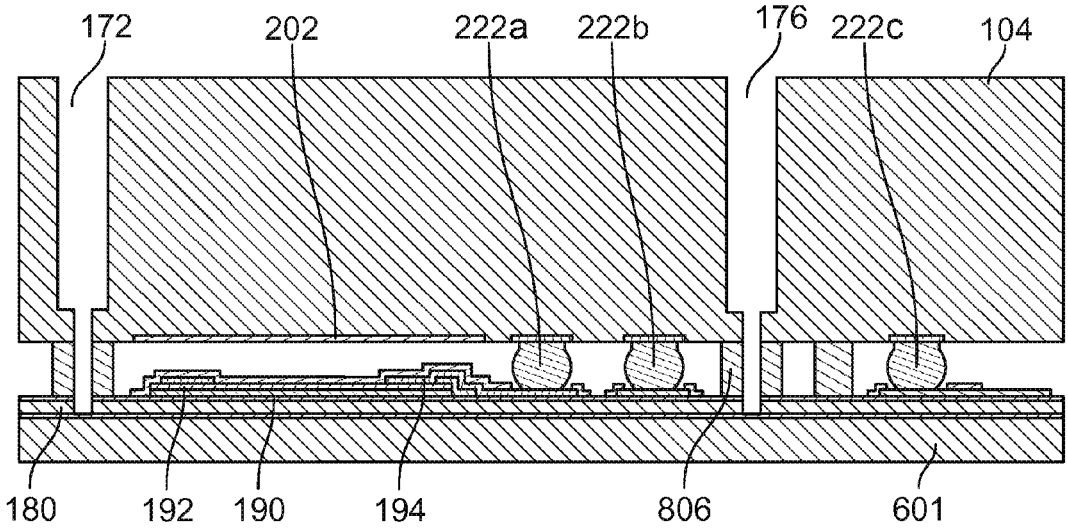
Figure 15O:
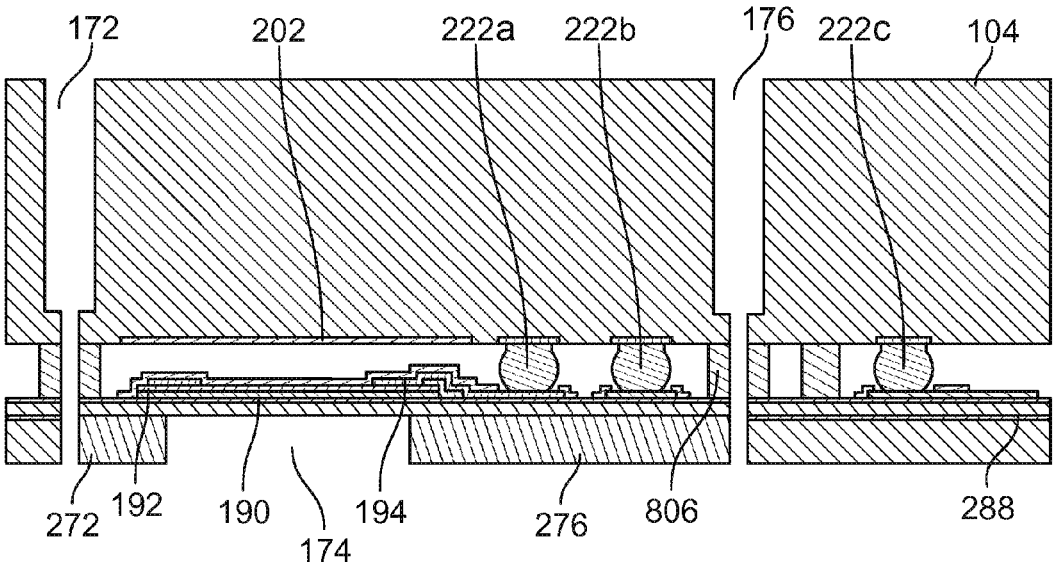
Figure 15P:
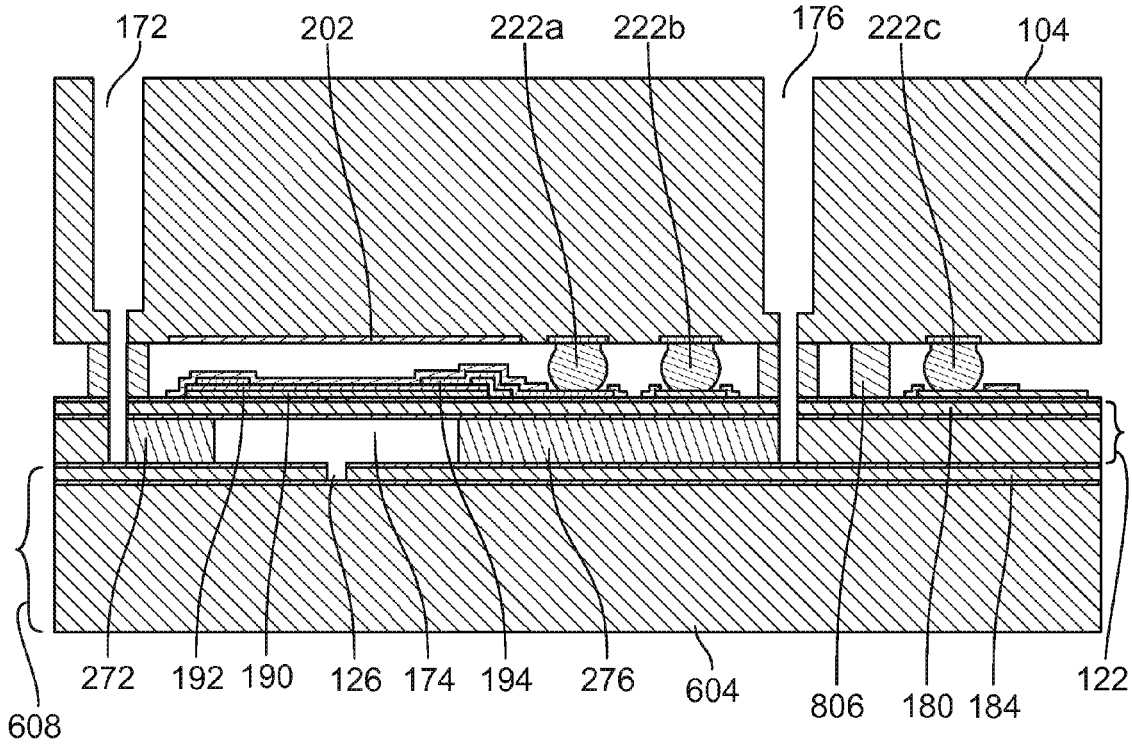
Figure 15Q:
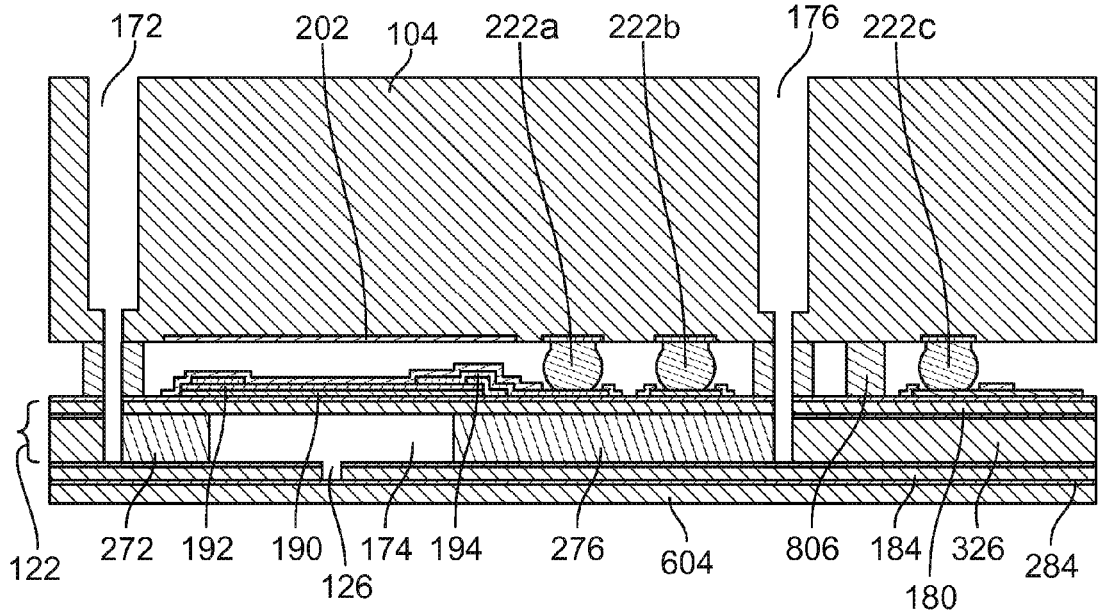
Figure 15R:
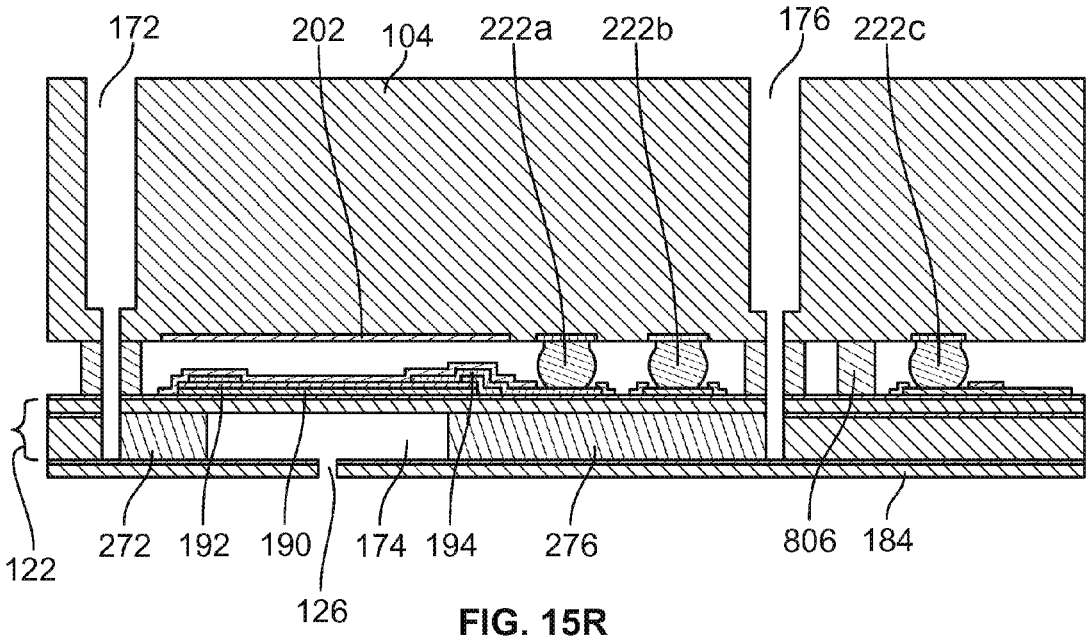
Figure 15S:
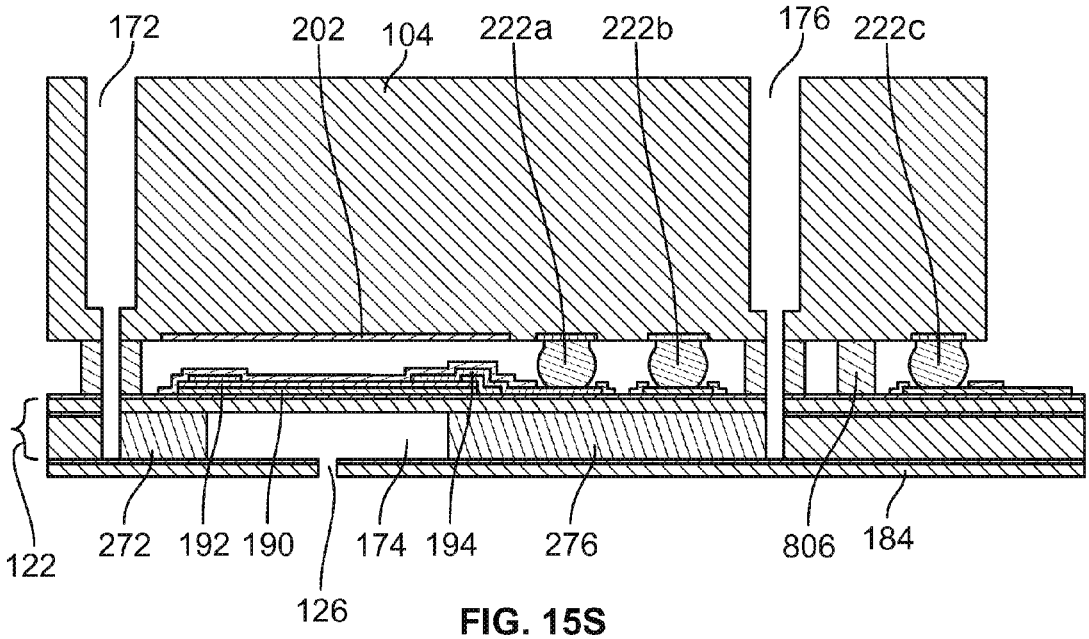
Figure 15T:
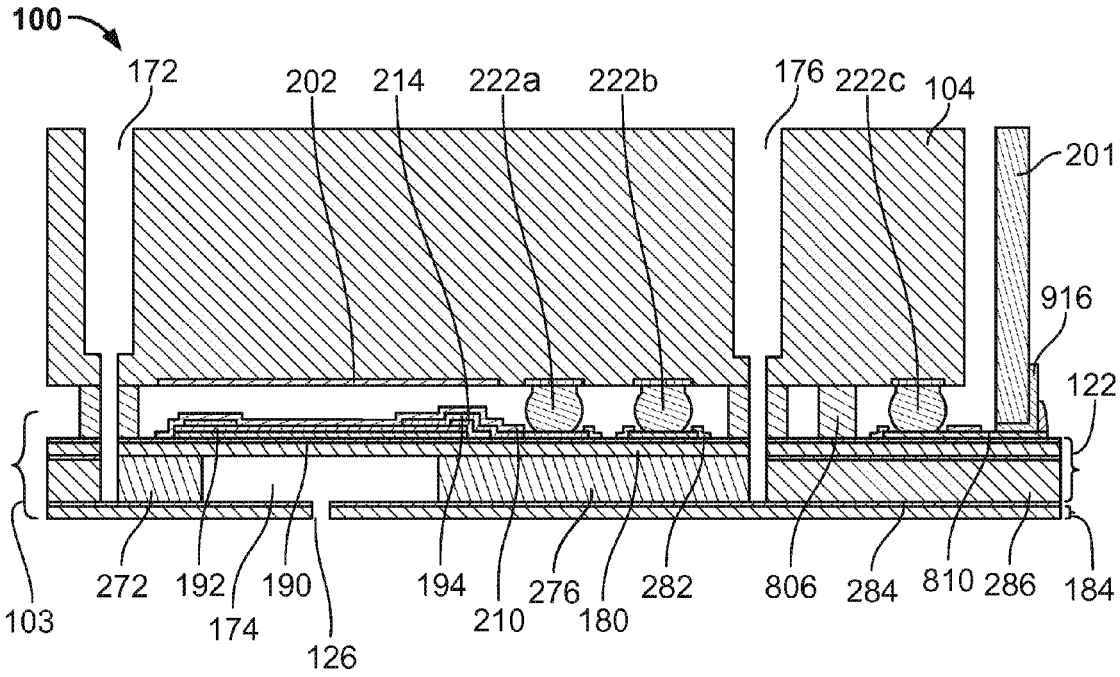

FIGS. 15A-T show an exemplary method for fabricating the fluid ejector 100. The lower electrode 190 is sputtered onto a wafer 122 having a membrane 180, e.g. a semiconductor wafer such as a silicon-on-oxide (SOI) wafer (see FIG. 15A). A piezoelectric layer 192 is then sputtered over the lower electrode 190 (see FIG. 15B) and etched (see FIG. 15C). The lower electrode 190 can be etched (see FIG. 15D)

and the bottom protective layer 214 applied (see FIG. 15E). The upper electrode 194 can then be sputtered and etched (see FIG. 15F), and the upper protective layer 210 applied (see FIG. 15G). The barrier material 806 to protect the fluid paths 124 from leaking fluid can then be applied, forming apertures 802 therebetween (see FIG. 15H). The apertures 702 can then be etched into the membrane layer 180 (see FIG. 15I) such that they align with the apertures 802. Optionally, an oxide layer 288 can be used as an etch stop.

The integrated circuit interposer 104, e.g. ASIC wafer, can be formed with integrated circuit elements 202 and leads 222*a*, 222*b*, and 222*c* (see FIG. 15J). As shown in FIGS. 15K and 15L, apertures 902 can be etched into the integrated circuit interposer 104, e.g., using deep reactive ion etching, to form part of the fluid paths. The apertures 902 can first be etched into the bottom surface of the integrated circuit interposer 104, i.e., the surface containing the integrated circuit elements 202 (see FIG. 15K). The apertures 902 can then be completed by etching a larger diameter hole from the top of the integrated circuit interposer 104 (see FIG. 15L). The larger diameter hole makes the etching process easier and allows a protective metal layer to be sputtered down the aperture 902 in order to protect the aperture 902 from fluid corrosion.

Following the etching, the integrated circuit interposer 104 and the wafer 122 can be bonded together using a spun-on adhesive, such as BCB or Polyimide or Epoxy (see FIG. 15M). Alternatively, the adhesive can be sprayed onto the integrated circuit interposer 104 and the wafer 122. The bonding of the integrated circuit interposer 104 and the wafer 122 is performed such that the apertures 902 of the integrated circuit interposer, apertures 802 of the pumping chamber layer, and the apertures 702 of the membrane layer 180 can align to form fluid inlet and outlet channels 172, 176.

A handle layer 601 of the wafer 122 can then be ground and polished (see FIG. 15N). Although not shown, the integrated circuit interposer 104 may need to be protected during grinding. The pumping chambers 174, including the pumping chamber inlets and outlets 276, 272, can be etched into the wafer 122 from the bottom of the wafer 122, i.e. on the opposite side as the integrated circuit interposer 104 (see FIG. 15O). Optionally, an oxide layer 288 can be used as an etch stop. A nozzle wafer 608 including nozzles 126 already etched into the nozzle layer 184 can then be bound to the wafer 122 using low-temperature bonding, such as bonding with an epoxy, such as BCB, or using low temperature plasma activated bonding. (see FIG. 15P) For example, the nozzle layer can be bonded to the wafer 122 at a temperature of between about 200° C. and 300° C. to avoid harming the piezoelectric layer 122 already bound to the structure. A nozzle handle layer 604 of the nozzle wafer 608 can then be ground and polished, optionally using an oxide layer 284 as an etch stop (see FIG. 15Q). Again, although not shown, the integrated circuit interposer 104 may need to be protected during grinding). The nozzles can then be opened by removing the oxide layer 284 (see FIG. 15R). As noted above, the nozzle layer 184 and pumping chamber layer 326 can also be formed out of a photodefinable film.

Figure 16:
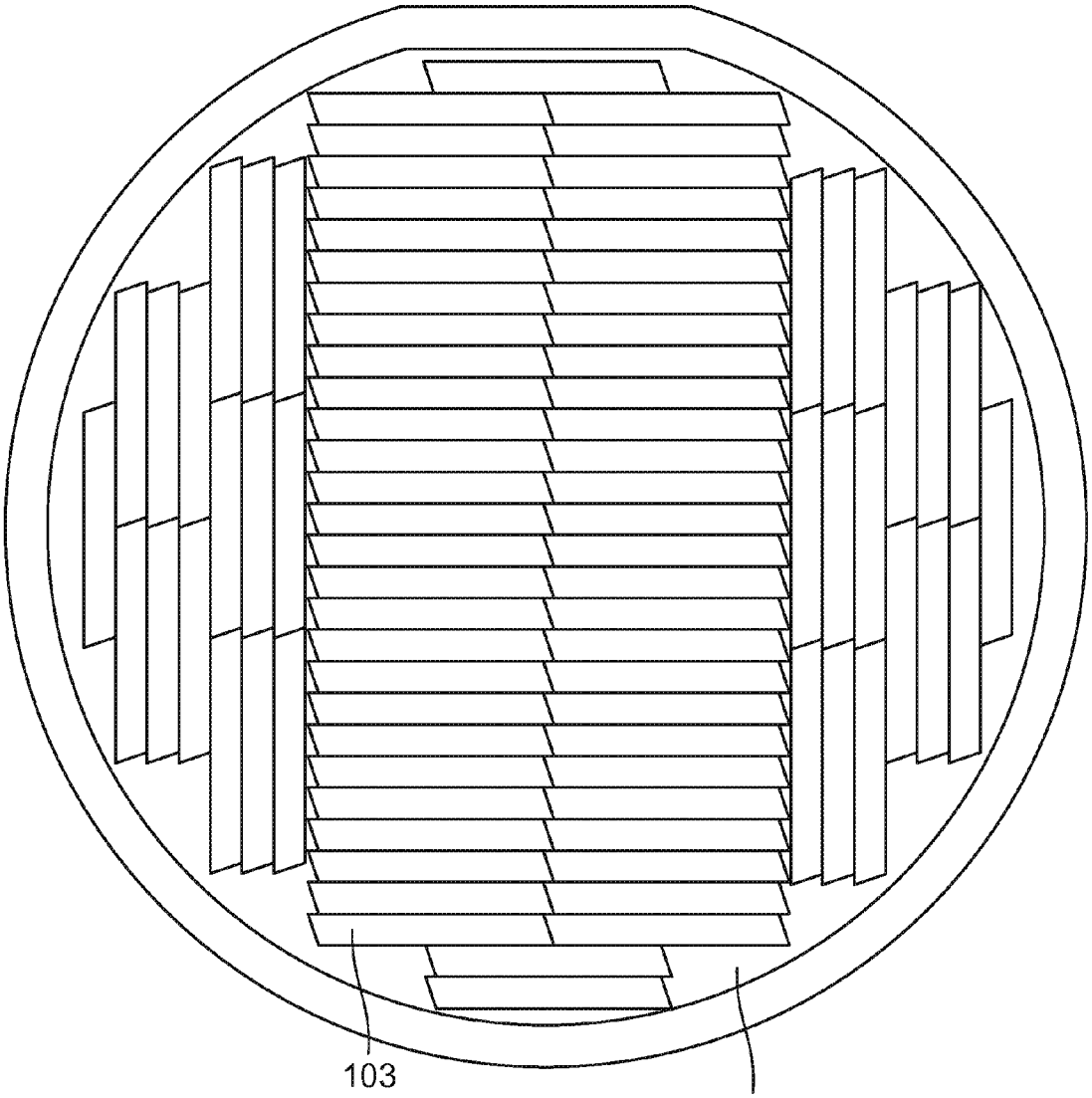
FIG. 16 is a schematic diagram of a wafer having 88 dies.

Finally, the wafer can be singulated (see FIG. 15Q), i.e., cut into a number of dies 103, e.g. dies having the shape of a rectangle, parallelogram, or trapezoid. As shown in FIG. 16, the dies 103 of the fluid ejector 100 are small enough, e.g. approximately 5-6 mm in width and 30-40 mm in length, such that at least 40 dies each having at least 300 pumping chambers can be formed on a 150 mm wafer. For example, as shown in FIG. 16, 88 dies 103 can be formed from a single 200 mm wafer 160. The flex 201 can then be attached to the fluid ejector (see FIG. 15T).

The fabrication steps described herein need not be performed in the sequence listed. The fabrication can be less expensive than fluid ejector having more silicon.

A fluid ejector 100 as described herein, e.g., with no descender between the pumping chamber and the nozzle, with a layer separate from the die including logic to control ejection of the actuators in the die, and with fluid inlet and outlet passages in the housing rather than the die, can be low cost, can print high quality images, and can print at high speeds. For example, by not having a descender between the nozzle and the pumping chamber fluid can travel through the layer quickly, thereby allowing for ejection of fluid at high frequencies, for example 180 kHz to 390 kHz with low drive voltage, for example less than 20V, such as 17V. Likewise, by not having an ascender in the pumping chamber layer, the pumping chamber layer can be thinner. Such a design can permit a droplet size of 2 pl or less to be formed from a nozzle having a width of greater than 15 μm.

Further, by having logic in the integrated circuit interposer rather than on the substrate, there can be fewer traces and electrical connections on the substrate such that a high density pumping chamber and nozzle matrix can be formed. Likewise, a high density pumping chamber and nozzle matrix can be formed by having only pumping chambers inlets and outlets in the pumping chamber layer, and not, for example, an ascender. As a result, a dpi of greater than 600 can be formed on a print media, and at least 88 dies can be formed per six inch wafer.

By having fluid inlet and outlet passages in the housing, rather than the substrate, cross-talk between fluid passages can be minimized. Finally, by using a photodefinable film rather than silicon, and by not including extra silicon, such as interposers, the cost of the fluid ejector can be kept low.

Particular embodiments have been described. Other embodiments are within the scope of the following claims.

What is claimed is:

1. A fluid ejector, comprising:

a fluid ejection module comprising a substrate having a plurality of fluid ejection elements arranged in a matrix, each fluid ejection element configured to cause a fluid to be ejected from a nozzle; and a microchip, bonded to the substrate, comprising a plurality of electrical connections, and a plurality of integrated switching elements, the plurality of electrical connections and the plurality of integrated switching elements being arranged in a matrix corresponding to the matrix of the fluid ejection elements with each electrical connection having an associated integrated switching element electrically connected to the electrical connection, and wherein each pair of electrical connection and associated integrated switching element is adjacent to a corresponding fluid ejection element, wherein each fluid ejection element is connected to a corresponding inlet channel and a corresponding outlet channel, the inlet channels and outlet channels passing through the microchip.

2. The fluid ejector of claim 1, wherein the microchip further comprises a plurality of fluid paths therethrough.

3. The fluid ejector of claim 1, wherein the plurality of fluid paths are coated with a barrier material.

4. The fluid ejector of claim 3, wherein the barrier material comprises titanium, tantalum, aluminum oxide, or silicon oxide.

5. The fluid ejector of claim 1, further comprising a barrier layer between the microchip and the fluid ejection module.

6. The fluid ejector of claim 1, wherein the microchip further comprises logic configured to control the plurality of integrated switching elements.

7. The fluid ejector of claim 1, wherein each fluid ejection element is positioned directly adjacent to at least one switching element.

8. The fluid ejector of claim 7, wherein there are two switching elements for every fluid ejection element.

9. The fluid ejector of claim 1, further comprising a plurality of gold bumps, each gold bump configured to contact an electrode of a corresponding fluid ejection element.

10. the fluid ejector of claim 1, wherein the microchip is an application-specific integrated circuit.

11. A fluid ejector, comprising:

a fluid ejection module comprising a substrate having a first plurality of fluid paths and a plurality of fluid ejection elements, each fluid ejection element configured to cause a fluid to be ejected from a nozzle of an associated fluid path, the plurality of fluid ejection elements being arranged in a matrix; and an integrated circuit interposer mounted on the fluid ejection module, the integrated circuit interposer comprising:

a plurality of electrical connections and a plurality of integrated switching elements, the plurality of electrical connections and the plurality of integrated switching elements being arranged in a matrix corresponding to the matrix of the fluid ejection elements with each electrical connection having an associated integrated switching element electrically connected to the electrical connection, and wherein each pair of electrical connection and associated integrated switching element is adjacent to a corresponding fluid ejection element, and a second plurality of fluid paths in fluid connection with the first plurality of fluid paths, wherein the integrated circuit interposer is electrically connected with the fluid ejection module such that an electrical connection of the fluid ejection module enables a signal sent to the fluid ejection module to be transmitted to the integrated circuit interposer, processed on the integrated circuit interposer, and output to the fluid ejection module to drive at least on of the plurality of fluid ejection elements, wherein the second plurality of fluid paths comprises an inlet channel and an outlet channel corresponding to each fluid ejection element, the inlet channels and the outlet channels passing through the integrated circuit interposer.

12. The fluid ejector of claim 11, wherein the second plurality of fluid paths are coated with a barrier material.

13. The fluid ejector of claim 12, wherein the barrier material comprises titanium, tantalum, aluminum oxide, or silicon oxide.

14. The fluid ejector of claim 11, further comprising a barrier layer between the integrated circuit interposer and the fluid ejection module.

15. The fluid ejector of claim 11, wherein the integrated circuit interposer further comprises logic configured to control the plurality of integrated switching elements.

16. The fluid ejector of claim 11, wherein each fluid ejection element is positioned directly adjacent to at least one switching element.

17. The fluid ejector of claim 16, wherein there are two switching elements for every fluid ejection element.

18. The fluid ejector of claim 11, further comprising a plurality of gold bumps, each gold bump configured to contact an electrode of a corresponding fluid ejection element.

* * * * *

UNITED STATES PATENT AND TRADEMARK OFFICE

CERTIFICATE OF CORRECTION

PATENT NO. : 8,820,895 B2
APPLICATION NO. : 12/833828
DATED : September 2, 2014
INVENTOR(S) : Andreas Bibl et al.

It is certified that error appears in the above-identified patent and that said Letters Patent is hereby corrected as shown below:

In the Claims

Column 19, Line 14, in Claim 10, delete “the” and insert -- The --.

Column 20, Line 9, in Claim 11, delete “on” and insert -- one --.

Signed and Sealed this
Eighteenth Day of November, 2014

Michelle K. Lee

Michelle K. Lee
*Deputy Director of the United States Patent and Trademark Office*